US007837504B2

(12) United States Patent
Hull et al.

(10) Patent No.: US 7,837,504 B2
(45) Date of Patent: Nov. 23, 2010

(54) IMPEDANCE MATING INTERFACE FOR ELECTRICAL CONNECTORS

(75) Inventors: Gregory A Hull, York, PA (US); Stephen B Smith, Mechanicsburg, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 12/420,439

(22) Filed: Apr. 8, 2009

(65) Prior Publication Data

US 2009/0191756 A1 Jul. 30, 2009

Related U.S. Application Data

(60) Division of application No. 11/229,778, filed on Sep. 19, 2005, now Pat. No. 7,524,209, which is a continuation-in-part of application No. 10/946,874, filed on Sep. 22, 2004, now Pat. No. 7,517,250.

(60) Provisional application No. 60/506,427, filed on Sep. 26, 2003.

(51) Int. Cl.
*H01R 13/648* (2006.01)

(52) U.S. Cl. ..... 439/607.05; 439/108; 439/607.11

(58) Field of Classification Search ..... 439/607.05, 439/941, 108, 701, 607.11
See application file for complete search history.

(56) References Cited

U.S. PATENT DOCUMENTS

| | | | |
|---|---|---|---|
| 3,286,220 | A | 11/1966 | Marley et al. |
| 3,390,369 | A | 6/1968 | Zavertnik et al. |
| 3,538,486 | A | 11/1970 | Shlesinger, Jr. |
| 3,587,028 | A | 6/1971 | Uberbacher |
| 3,669,054 | A | 6/1972 | Desso et al. |
| 3,748,633 | A | 7/1973 | Lundergan |
| 4,045,105 | A | 8/1977 | Lee et al. |
| 4,076,362 | A | 2/1978 | Ichimura |
| 4,159,861 | A | 7/1979 | Anhalt |
| 4,260,212 | A | 4/1981 | Ritchie et al. |
| 4,288,139 | A | 9/1981 | Cobaugh et al. |
| 4,383,724 | A | 5/1983 | Verhoeven |

(Continued)

FOREIGN PATENT DOCUMENTS

EP 0273683 A2 7/1988

(Continued)

OTHER PUBLICATIONS

"FCI's Airmax VS® Connector System Honored at DesignCon", 2005, Heilind Electronics, Inc., http://www.heilind.com/products/fci/airmax-vs-design.asp, 1 page.

(Continued)

*Primary Examiner*—Xuong M Chung-Trans
(74) *Attorney, Agent, or Firm*—Woodcock Washburn LLP

(57) ABSTRACT

Electrical connectors having improved impedance characteristics are disclosed. Such an electrical connector may include a first electrically conductive contact, and a second electrically conductive contact disposed adjacent to the first contact along a first direction. A mating end of the second contact may be offset in a second direction relative to a mating end of the first contact. Offsetting of contacts within columns of contacts provides capability for adjusting impedance and capacitance characteristics of a connector assembly.

20 Claims, 22 Drawing Sheets

U.S. PATENT DOCUMENTS

| | | | |
|---|---|---|---|
| 4,402,563 | A | 9/1983 | Sinclair |
| 4,482,937 | A | 11/1984 | Berg |
| 4,560,222 | A | 12/1985 | Dambach |
| 4,717,360 | A | 1/1988 | Czaja |
| 4,734,060 | A | 3/1988 | Kawawada et al. |
| 4,776,803 | A | 10/1988 | Pretchel et al. |
| 4,815,987 | A | 3/1989 | Kawano et al. |
| 4,867,713 | A | 9/1989 | Ozu et al. |
| 4,907,990 | A | 3/1990 | Bertho et al. |
| 4,913,664 | A | 4/1990 | Dixon |
| 4,973,271 | A | 11/1990 | Ishizuka et al. |
| 5,066,236 | A | 11/1991 | Broeksteeg |
| 5,077,893 | A | 1/1992 | Mosquera et al. |
| 5,098,311 | A | 3/1992 | Roath et al. |
| 5,163,849 | A | 11/1992 | Fogg et al. |
| 5,167,528 | A | 12/1992 | Nishiyama et al. |
| 5,174,770 | A | 12/1992 | Sasaki et al. |
| 5,192,231 | A | 3/1993 | Dolin, Jr. |
| 5,224,867 | A | 7/1993 | Ohtsuki et al. |
| 5,238,414 | A | 8/1993 | Yaegashi et al. |
| 5,254,012 | A | 10/1993 | Wang |
| 5,274,918 | A | 1/1994 | Reed |
| 5,277,624 | A | 1/1994 | Champion et al. |
| 5,286,212 | A | 2/1994 | Broekstaag |
| 5,302,135 | A | 4/1994 | Lee |
| 5,342,211 | A | 8/1994 | Broekstagg |
| 5,356,300 | A | 10/1994 | Costello et al. |
| 5,356,301 | A | 10/1994 | Champion et al. |
| 5,357,050 | A | 10/1994 | Baran et al. |
| 5,431,578 | A | 7/1995 | Wayne |
| 5,475,922 | A | 12/1995 | Tamura et al. |
| 5,525,067 | A | 6/1996 | Gatti |
| 5,558,542 | A | 9/1996 | O'Sullivan et al. |
| 5,586,914 | A | 12/1996 | Foster, Jr. et al. |
| 5,590,463 | A | 1/1997 | Feldman et al. |
| 5,609,502 | A | 3/1997 | Thumma |
| 5,713,746 | A | 2/1998 | Olson et al. |
| 5,730,609 | A | 3/1998 | Harwath |
| 5,741,144 | A | 4/1998 | Elco et al. |
| 5,741,161 | A | 4/1998 | Cahaly et al. |
| 5,795,191 | A | 8/1998 | Preputnick et al. |
| 5,817,973 | A | 10/1998 | Elco et al. |
| 5,853,797 | A | 12/1998 | Fuchs et al. |
| 5,908,333 | A | 6/1999 | Perino et al. |
| 5,925,274 | A | 7/1999 | McKinney et al. |
| 5,961,355 | A | 10/1999 | Morlion et al. |
| 5,967,844 | A | 10/1999 | Doutrich et al. |
| 5,971,817 | A | 10/1999 | Longueville |
| 5,980,321 | A | 11/1999 | Cohen et al. |
| 5,993,259 | A | 11/1999 | Stokoe et al. |
| 6,042,389 | A | 3/2000 | Lemke et al. |
| 6,050,862 | A | 4/2000 | Ishii |
| 6,068,520 | A | 5/2000 | Winings et al. |
| 6,099,332 | A | 8/2000 | Troyan |
| 6,116,926 | A | 9/2000 | Ortega et al. |
| 6,116,965 | A | 9/2000 | Arnett et al. |
| 6,123,554 | A | 9/2000 | Ortega et al. |
| 6,125,535 | A | 10/2000 | Chiou et al. |
| 6,129,592 | A | 10/2000 | Mickievicz et al. |
| 6,139,336 | A | 10/2000 | Olson |
| 6,146,157 | A | 11/2000 | Lenoir et al. |
| 6,146,203 | A | 11/2000 | Elco et al. |
| 6,150,729 | A | 11/2000 | Ghahghahi |
| 6,171,115 | B1 | 1/2001 | Mickievicz et al. |
| 6,171,149 | B1 | 1/2001 | Van Zanten |
| 6,190,213 | B1 | 2/2001 | Reichart et al. |
| 6,212,755 | B1 | 4/2001 | Shimada et al. |
| 6,219,913 | B1 | 4/2001 | Uchiyama |
| 6,220,896 | B1 | 4/2001 | Bertoncini et al. |
| 6,227,882 | B1 | 5/2001 | Ortega et al. |
| 6,267,604 | B1 | 7/2001 | Mickievicz et al. |
| 6,269,539 | B1 | 8/2001 | Takahashi et al. |
| 6,280,209 | B1 | 8/2001 | Bassler et al. |
| 6,293,827 | B1 | 9/2001 | Stokoe et al. |
| 6,319,075 | B1 | 11/2001 | Clark et al. |
| 6,322,379 | B1 | 11/2001 | Ortega et al. |
| 6,322,393 | B1 | 11/2001 | Doutrich et al. |
| 6,328,602 | B1 | 12/2001 | Yamasaki et al. |
| 6,343,955 | B2 | 2/2002 | Billman et al. |
| 6,347,952 | B1 | 2/2002 | Hasegawa et al. |
| 6,350,134 | B1 | 2/2002 | Fogg et al. |
| 6,354,877 | B1 | 3/2002 | Shuey et al. |
| 6,358,061 | B1 | 3/2002 | Regnier |
| 6,361,366 | B1 | 3/2002 | Shuey et al. |
| 6,363,607 | B1 | 4/2002 | Chen et al. |
| 6,364,710 | B1 | 4/2002 | Billman et al. |
| 6,368,121 | B1 | 4/2002 | Ueno et al. |
| 6,371,773 | B1 | 4/2002 | Crofoot et al. |
| 6,375,478 | B1 | 4/2002 | Kikuchi |
| 6,379,188 | B1 | 4/2002 | Cohen et al. |
| 6,386,914 | B1 | 5/2002 | Collins et al. |
| 6,409,543 | B1 | 6/2002 | Astbury, Jr. et al. |
| 6,431,914 | B1 | 8/2002 | Billman |
| 6,435,913 | B1 | 8/2002 | Billman |
| 6,435,914 | B1 | 8/2002 | Billman |
| 6,461,202 | B2 | 10/2002 | Kline |
| 6,471,548 | B2 | 10/2002 | Bertoncini et al. |
| 6,482,038 | B2 | 11/2002 | Olson |
| 6,485,330 | B1 | 11/2002 | Doutrich |
| 6,494,734 | B1 | 12/2002 | Shuey et al. |
| 6,503,103 | B1 | 1/2003 | Cohen et al. |
| 6,506,081 | B2 | 1/2003 | Blanchfield et al. |
| 6,520,803 | B1 | 2/2003 | Dunn |
| 6,527,587 | B1 | 3/2003 | Ortega et al. |
| 6,537,111 | B2 | 3/2003 | Brammer et al. |
| 6,540,559 | B1 | 4/2003 | Kemmick et al. |
| 6,547,066 | B2 | 4/2003 | Koch |
| 6,547,606 | B1 | 4/2003 | Johnston et al. |
| 6,554,647 | B1 | 4/2003 | Cohen et al. |
| 6,572,410 | B1 | 6/2003 | Volstorf et al. |
| 6,602,095 | B2 | 8/2003 | Astbury, Jr. et al. |
| 6,609,933 | B2 | 8/2003 | Yamasaki et al. |
| 6,641,411 | B1 | 11/2003 | Stoddard |
| 6,652,318 | B1 * | 11/2003 | Winings et al. ..... 439/607.07 |
| 6,652,319 | B1 | 11/2003 | Billman |
| 6,672,907 | B2 | 1/2004 | Azuma |
| 6,692,272 | B2 | 2/2004 | Lemke et al. |
| 6,695,627 | B2 | 2/2004 | Ortega et al. |
| 6,700,455 | B2 | 3/2004 | Tripathi et al. |
| 6,717,825 | B2 | 4/2004 | Volstorf |
| 6,762,067 | B1 | 7/2004 | Quinones et al. |
| 6,764,341 | B2 | 7/2004 | Lappoehn |
| 6,776,649 | B2 | 8/2004 | Pape et al. |
| 6,805,278 | B1 | 10/2004 | Olson et al. |
| 6,808,399 | B2 | 10/2004 | Rothermel et al. |
| 6,824,391 | B2 | 11/2004 | Mickievicz et al. |
| 6,843,686 | B2 | 1/2005 | Ohnishi et al. |
| 6,848,944 | B2 | 2/2005 | Evans |
| 6,851,974 | B2 | 2/2005 | Doutrich |
| 6,852,567 | B1 | 2/2005 | Lee et al. |
| 6,863,543 | B2 | 3/2005 | Lang et al. |
| 6,869,292 | B2 | 3/2005 | Johnescu et al. |
| 6,890,214 | B2 | 5/2005 | Brown et al. |
| 6,905,368 | B2 | 6/2005 | Mashiyama et al. |
| 6,913,490 | B2 | 7/2005 | Whiteman, Jr. et al. |
| 6,932,649 | B1 | 8/2005 | Rothermel et al. |
| 6,945,796 | B2 | 9/2005 | Bassler et al. |
| 6,953,351 | B2 | 10/2005 | Fromm et al. |
| 6,969,268 | B2 | 11/2005 | Brunker |
| 6,969,280 | B2 | 11/2005 | Chien et al. |
| 6,976,886 | B2 | 12/2005 | Winings et al. |
| 6,979,226 | B2 | 12/2005 | Otsu et al. |
| 6,981,883 | B2 | 1/2006 | Raistrick et al. |
| 6,988,902 | B2 | 1/2006 | Winings et al. |

| | | | | |
|---|---|---|---|---|
| 6,994,569 | B2 | 2/2006 | Minich et al. | |
| 7,057,115 | B2 | 6/2006 | Clink et al. | |
| 7,097,506 | B2 | 8/2006 | Nakada | |
| 7,118,391 | B2 | 10/2006 | Minich et al. | |
| 7,131,870 | B2 | 11/2006 | Whiteman, Jr. et al. | |
| 7,157,250 | B2 | 1/2007 | Gabriel | |
| 7,182,643 | B2 | 2/2007 | Winings | |
| 7,207,807 | B2 | 4/2007 | Fogg | |
| 7,229,318 | B2 | 6/2007 | Winings et al. | |
| 7,320,621 | B2 | 1/2008 | Laurx | |
| 7,331,800 | B2 | 2/2008 | Winings et al. | |
| 7,407,413 | B2 | 8/2008 | Minich | |
| 7,422,484 | B2 | 9/2008 | Cohen et al. | |
| 7,524,209 | B2 * | 4/2009 | Hull et al. | 439/607.01 |
| 2002/0098727 | A1 | 7/2002 | McNamara et al. | |
| 2002/0106930 | A1 | 8/2002 | Pape et al. | |
| 2003/0143894 | A1 | 7/2003 | Kline et al. | |
| 2003/0171010 | A1 | 9/2003 | Winings et al. | |
| 2003/0203665 | A1 | 10/2003 | Ohnishi et al. | |
| 2003/0220021 | A1 | 11/2003 | Whiteman, Jr. et al. | |
| 2005/0009402 | A1 | 1/2005 | Chien et al. | |
| 2005/0020109 | A1 | 1/2005 | Raistrick et al. | |
| 2005/0118869 | A1 | 6/2005 | Evans | |
| 2005/0170700 | A1 | 8/2005 | Shuey et al. | |
| 2005/0277221 | A1 | 12/2005 | Mongold | |
| 2006/0014433 | A1 | 1/2006 | Consoli | |
| 2006/0046526 | A1 | 3/2006 | Minich | |
| 2006/0121749 | A1 | 6/2006 | Fogg | |
| 2006/0192274 | A1 | 8/2006 | Lee | |
| 2007/0099455 | A1 | 5/2007 | Rothermel et al. | |
| 2007/0205774 | A1 | 9/2007 | Minich | |
| 2007/0207641 | A1 | 9/2007 | Minich | |
| 2008/0085618 | A1 | 4/2008 | Sercu | |
| 2008/0102702 | A1 | 5/2008 | Sercu | |
| 2009/0011641 | A1 | 1/2009 | Cohen et al. | |

FOREIGN PATENT DOCUMENTS

| | | | |
|---|---|---|---|
| EP | 0891016 | | 10/2002 |
| EP | 1148587 | B1 | 4/2005 |
| JP | 06-236788 | | 8/1994 |
| JP | 07-114958 | | 5/1995 |
| JP | 11-185886 | | 7/1999 |
| JP | 2000-003743 | | 1/2000 |
| JP | 2000-003744 | | 1/2000 |
| JP | 2000-003745 | | 1/2000 |
| JP | 2000-003746 | | 1/2000 |
| WO | WO 90/16093 | | 12/1990 |
| WO | WO 01/29931 | A1 | 4/2001 |
| WO | WO 01/39332 | A1 | 5/2001 |
| WO | WO 02/101882 | | 12/2002 |
| WO | WO2006031296 | | 3/2006 |

OTHER PUBLICATIONS

"Lucent Technologies' Bell Labs and FCI Demonstrate 25gb/S Data Transmission over Electrical Backplane Connectors", Feb. 1, 2005, http://www.lucent.com/press/0205/050201.bla.html, 4 pages.

"Tyco Electronics, Z-Dok and Connector", *Tyco Electronics*, Jun. 23, 2003, http://Zdok.tyco.elcetronics.com, 15 pages.

4.0 UHD Connector Differential Signal Crosstalk, Reflections, 1998, p. 8-9.

*AMP Z-Pack 2mm HM Connector 2 mm Centerline,Eight-Row, Right Angle Applications, Electrical Performance Report*, EPR 889065, issued Sep. 1998, 59 pages.

AMP Z-Pack 2mm HM Interconnection System, 1992 and 1994© by AMP Incorporated, 6 pages.

*Amphenol TCS (ATCS): VHDM L-Series Connector*, http://www.teradyne.com/prods/tcs/products/connectors/backplane/vhdm_1-series/index.html, 2006, 4 pages.

Backplane Products Overview Page, http://www.molex.com/cgi-bin/bv/molex/super_family/super_family.jsp?BV_Session ID-@, 2005-2006© Molex, 4 pages.

Fusi, M.A. et al., "Differential Signal Transmission through Backplanes and Connectors", Electronic Packaging and Production, Mar. 1996, 27-31.

*Gig-Array ® High Speed Mezzanine Connectors 15-40 mm Board to Board*, Jun. 5, 2006, 1 page.

Goel, R.P. et al., "AMP Z-Pack Interconnect System", 1990, AMP Incorporated, 9 pages.

HDM/HDM *plus*, 2mm Backplane Interconnection System, Teradyne Connection Systems, © 1993, 22 pages.

*HDM® HDM Plus® Connectors*, http://www.teradyne.com/prods/tcs/products/connectors/backplane/hdm/index.html, 2006, 1 page.

Honda Connectors, "Honda High-Speed Backplane Connector NSP Series", Honda Tsushin Kogoyo Co., Ltd., Development Engineering Division, Tokyo , Japan, Feb. 7, 2003, 25 pages 2759 Only.

Hult, B., "FCI's Problem Solving Approach Changes Market, The FCI Electronics AirmMax VS®", ConnectorSupplier.com, Http://www.connectorsupplier.com/tech_updates_FCI-Airmax_archive.htm, 2006 4 pages.

Metral™, "Speed and Density Extensions", FCI, Jun. 3, 1999, 25 pages.

Nadolny, J. et al., "Optimizing Connector Selection for Gigabit Signal Speeds", *ECN™*, Sep. 1, 2000, http://www.ecnmag.com/article/CA45245, 6 pages.

Tyco Electronics, "Champ Z-Dok Connector System", Catalog # 1309281, Issued Jan. 2002, 3 pages.

*Tyco Electronics/AMP*, "Z-Dok and Z-Dok and Connectors", Application Specification # 114-13068, Aug. 30, 2005, Revision A, 16 pages.

VHDM Daughterboard Connectors Feature press-fit Terminations and a Non-Stubbing Seperable Interface, © Teradyne, Inc. Connections Systems Division, Oct. 8, 1997, 46 pages.

GbX I-Trac Backplane Connector System, two pages, Printout from: http://www.molex.com/molex/family/intro.jsp?oid=-17461&channel=Products&familyOID=-17461&frellink=Introduction&chanName=family&pageTitle=GbX%201-Trac™%20Backplane%20Connector%20System%20|%20Overview. Copyright 2005-2009.

Perspective View of Gigarray IMLA, 1998, 1 page.

Restriction Requirement for U.S. Appl. No. 11/924,002 , dated Apr. 10, 2008.

Office Action for U.S. Appl. No. 11/924,002 , dated Sep. 4, 2008.

Office Action for U.S. Appl. No. 11/924,002 , dated Apr. 29, 2009.

First Notice of Allowance for U.S. Appl. No. 11/924,002 , dated Feb. 24, 2009.

Second Notice of Allowance for U.S. Appl. No. 11/924,002 , dated Sep. 10, 2009.

Amendment filed in U.S. Appl. No. 11/924,002 on Jul. 29, 2009.

RCE and Amendment filed in U.S. Appl. No. 11/924,002 on Mar. 10, 2009.

Amendment filed in U.S. Appl. No. 11/924,002 on Mar. 20, 2009.

Response/Election filed in U.S. Appl. No. 11/924,002 on May 12, 2008.

Office Action for U.S. Appl. No. 11/866,061 , dated Jul. 15, 2008.

Office Action for U.S. Appl. No. 11/866,061 , dated Dec. 18, 2008.

Final Rejection for U.S. Appl. No. 11/866,061 , dated May 28, 2009.

Notice of Allowance for U.S. Appl. No. 11/866,061 , dated Aug. 21, 2009.

Amendment filed in U.S. Appl. No. 11/866,061 on Oct. 15, 2008.

Amendment filed in U.S. Appl. No. 11/866,061 on Mar. 18, 2009.

Amendment After Final filed in U.S. Appl. No. 11/866,061 on Jul. 29, 2009.

* cited by examiner

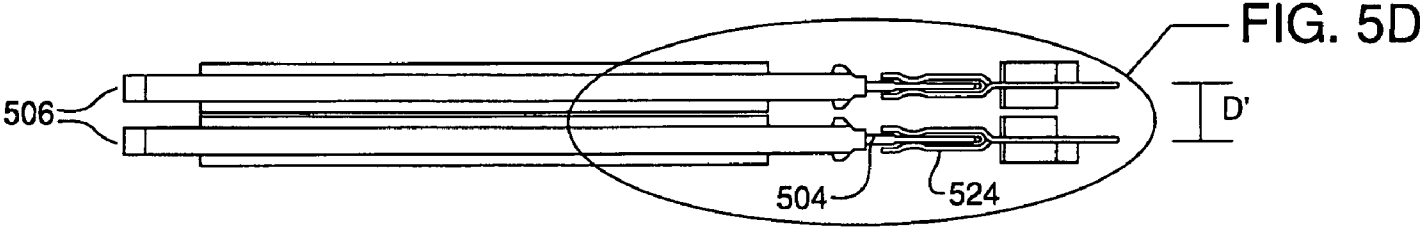
FIG. 5D
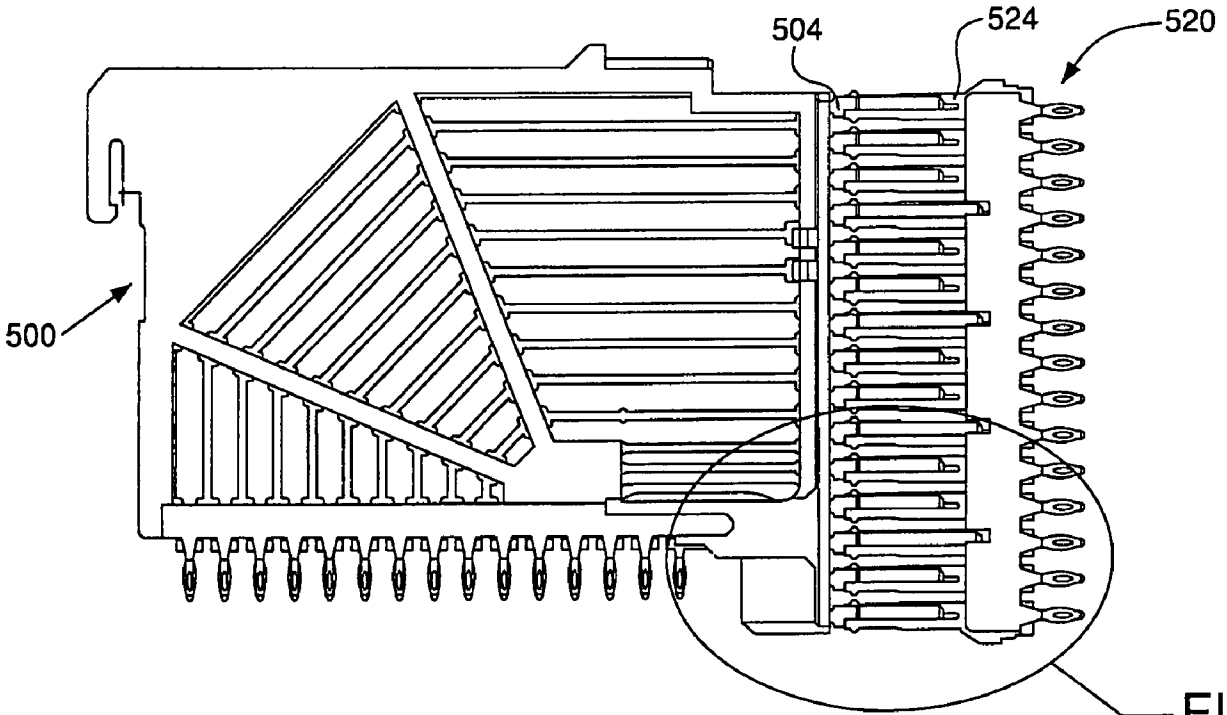
FIG. 5C
FIG. 5B
FIG. 5A

IMPEDANCE MATING INTERFACE FOR ELECTRICAL CONNECTORS

CROSS-REFERENCE TO RELATED APPLICATIONS

This is a divisional patent application of U.S. patent application Ser. No. 11/229,778 filed on Sep. 19, 2005, which is a continuation-in-part of U.S. patent application Ser. No. 10/946,874 filed on Sep. 22, 2004, which in-turn claims the benefit under 35 U.S.C. §119(e) of provisional U.S. patent application No. 60/506,427, filed Sep. 26, 2003.

The subject matter disclosed herein is related to the subject matter disclosed and claimed in U.S. patent application Ser. No. 10/634,547, filed Aug. 5, 2003, entitled "Electrical connectors having contacts that may be selectively designated as either signal or ground contacts," and in U.S. patent application Ser. No. 10/294,966, filed Nov. 14, 2002, which is a continuation-in-part of U.S. patent applications No. 09/990,794, filed Nov. 14, 2001, now U.S. Pat. No. 6,692,272, and Ser. No. 10/155,786, filed May 24, 2002, now U.S. Pat. No. 6,652,318.

The disclosure of each of the above-referenced U.S. patents and patent applications is herein incorporated by reference in its entirety.

FIELD OF THE INVENTION

Generally, the invention relates to electrical connectors. More particularly, the invention relates to improved impedance interfaces for electrical connectors.

BACKGROUND OF THE INVENTION

Electrical connectors can experience an impedance drop near the mating interface area of the connector. A side view of an example embodiment of an electrical connector is shown in FIG. 1A. The mating interface area is designated generally with the reference I and refers to the mating interface between the header connector H and the receptacle connector R.

FIG. 1B illustrates the impedance drop in the mating interface area. FIG. 1B is a reflection plot of differential impedance as a function of signal propagation time through a selected differential signal pair within a connector as shown in FIG. 1A. Differential impedance is measured at various times as the signal propagates through a first test board, a receptacle connector (such as described in detail below) and associated receptacle vias, the interface between the header connector and the receptacle connector, a header connector (such as described in detail below) and associated header vias, and a second test board. Differential impedance is shown measured for a 40 ps rise time from 10%-90% of voltage level.

As shown, the differential impedance is about 100 ohms throughout most of the signal path. At the interface between the header connector and receptacle connector, however, there is a drop from the nominal standard of approximately 100Ω, to an impedance of about 93/94Ω. Though the data shown in the plot of FIG. 1B is within acceptable standards (because the drop is within ±8Ω of the nominal impedance), there is room for improvement.

Additionally, there may be times when matching the impedance in a connector with the impedance of a device is necessary to prevent signal reflection, a problem generally magnified at higher data rates. Such matching may benefit from a slight reduction or increase in the impedance of a connector. Such fine-tuning of impedance in a conductor is a difficult task, usually requiring a change in the form or amount of dielectric material of the connector housing. Therefore, there is also a need for an electrical connector that provides for fine-tuning of connector impedance.

SUMMARY OF THE INVENTION

The invention provides for improved performance by adjusting impedance in the mating interface area. Such an improvement may be realized by moving and/or rotating the contacts in or out of alignment. Impedance may be minimized (and capacitance maximized) by aligning the edges of the contacts. Lowering capacitance, by moving the contacts out of alignment, for example, may increase impedance. The invention provides an approach for adjusting impedance, in a controlled manner, to a target impedance level. Thus, the invention provides for improved data flow through high-speed (e.g. >10 Gb/s) connectors.

BRIEF DESCRIPTION OF THE DRAWINGS

FIGS. 5A-5D depict engaged blade and receptacle contacts in a connector system.

DETAILED DESCRIPTION OF ILLUSTRATIVE EMBODIMENTS

Figure 2A:
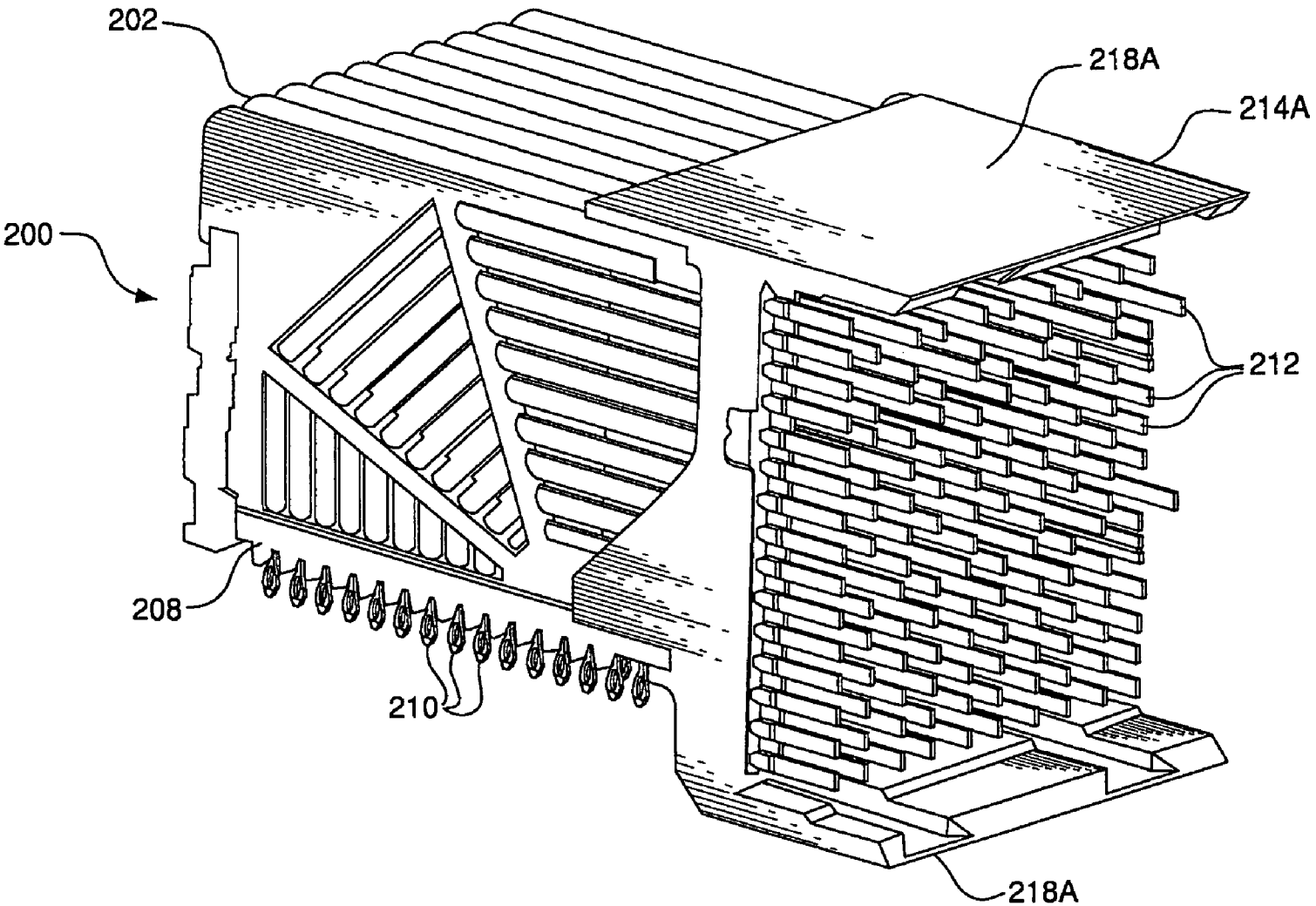
FIGS. 2A and 2B depict example embodiments of a header connector.
Figure 2B:
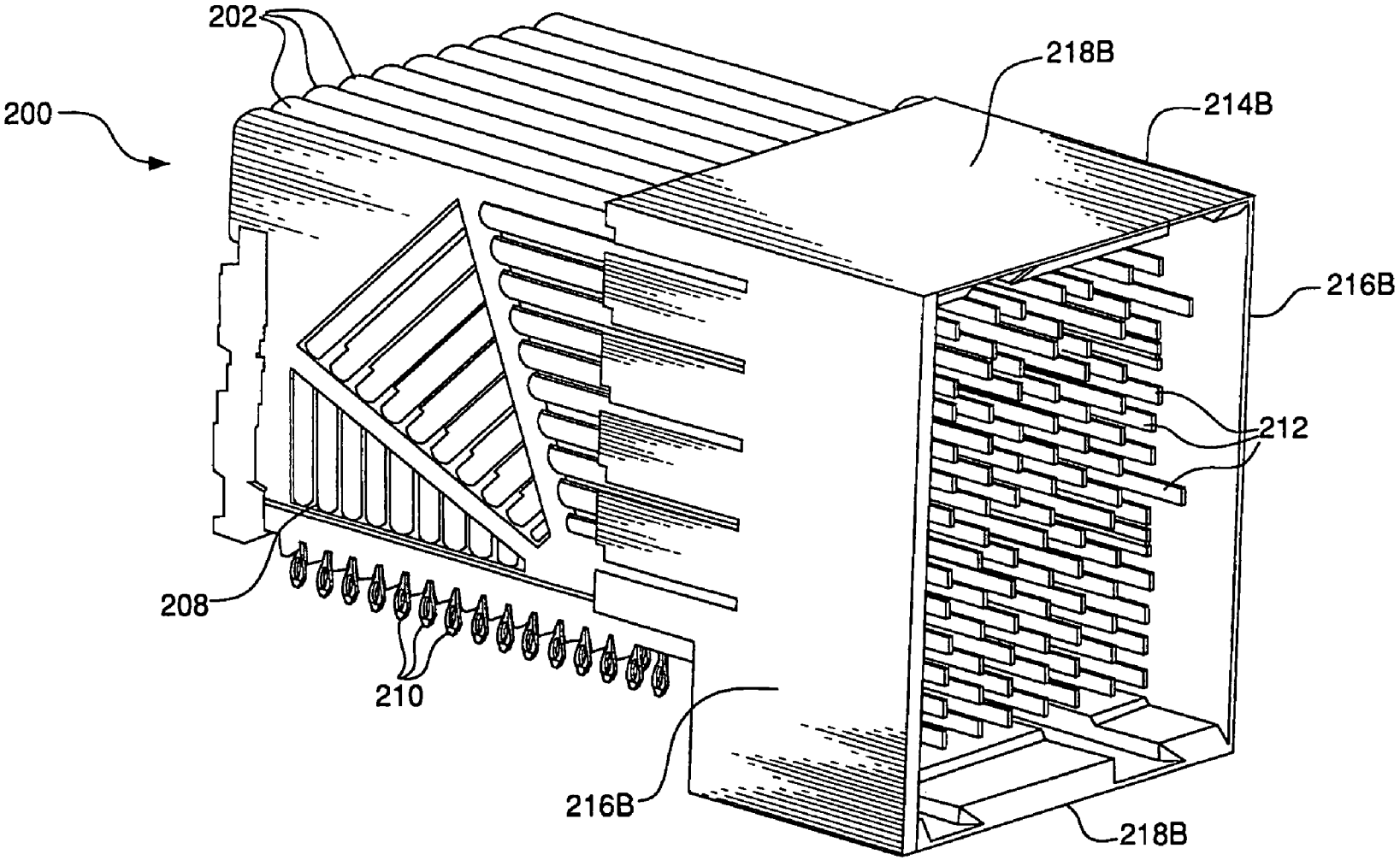
Figure 3A:
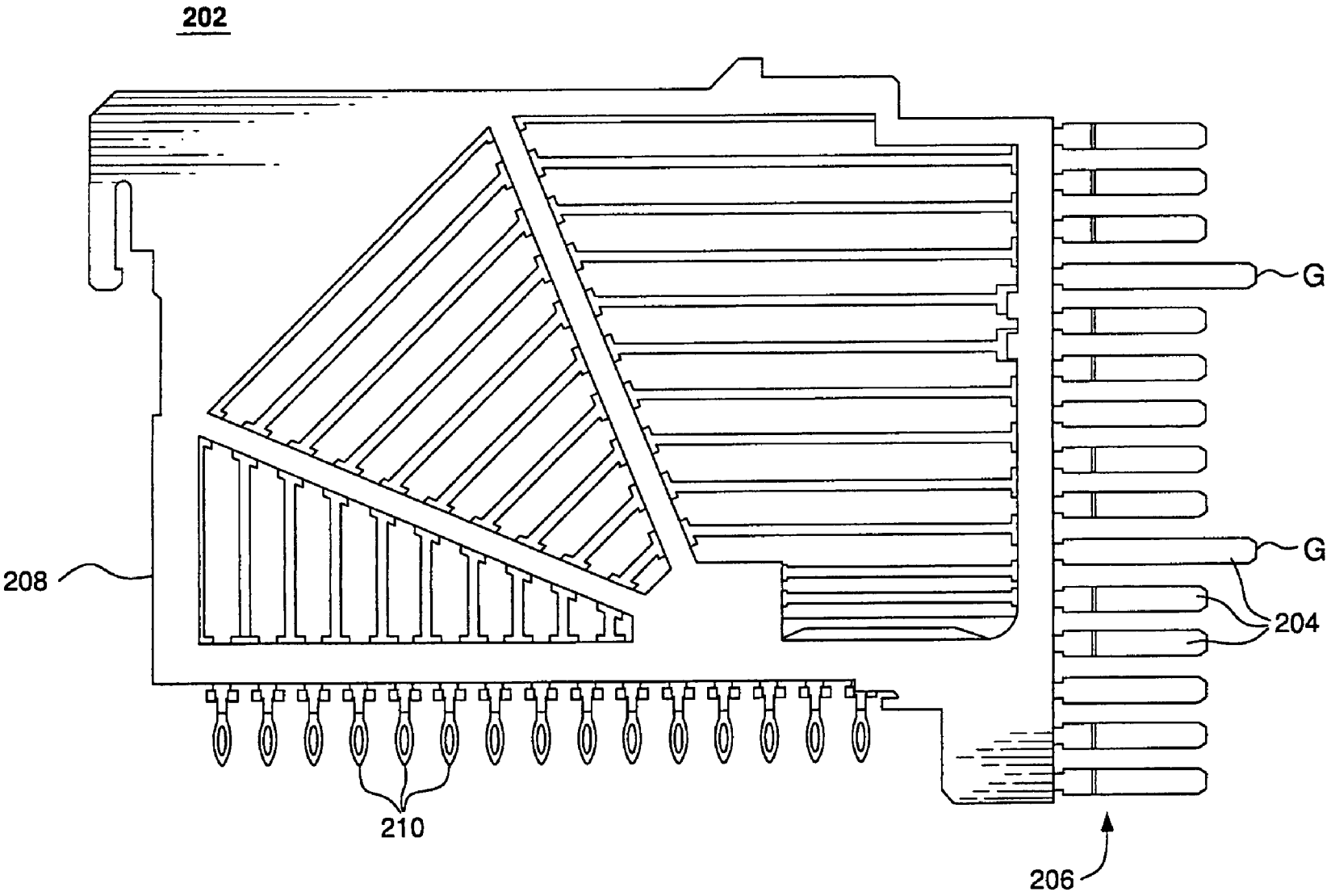
FIGS. 3A and 3B are side views of example embodiments of an insert molded lead frame assembly (IMLA).
Figure 3B:
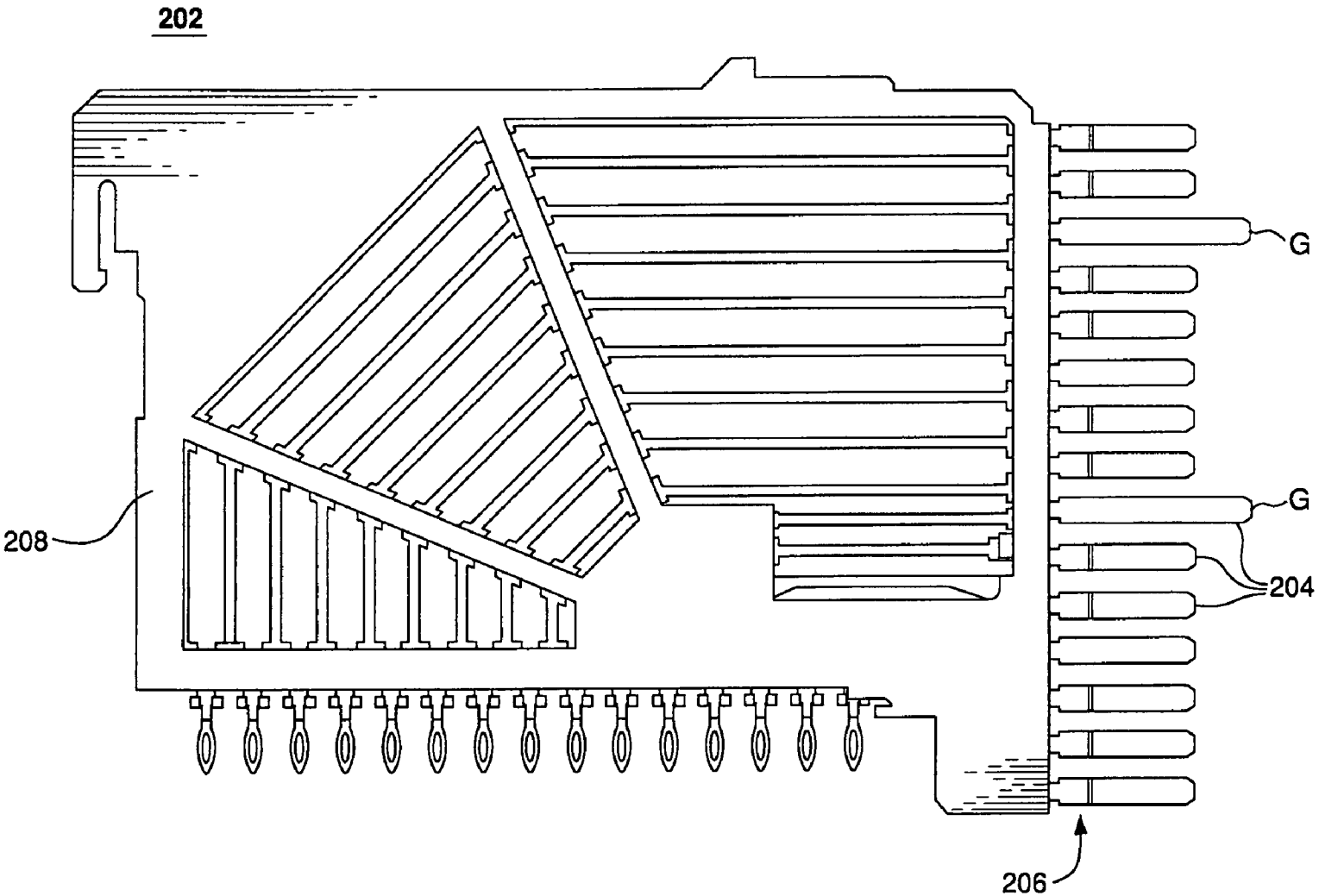

FIGS. 2A and 2B depict example embodiments of a header connector. As shown, the header connector 200 may include a plurality of insert molded lead frame assemblies (IMLAs) 202. FIGS. 3A and 3B are side views of example embodiments of an IMLA 202 according to the invention. An IMLA 202 includes a contact set 206 of electrically conductive contacts 204, and an IMLA frame 208 through which the contacts 204 at least partially extend. An IMLA 202 may be used, without modification, for single-ended signaling, differential signaling, or a combination of single-ended signaling and differential signaling. Each contact 204 may be selectively designated as a ground contact, a single-ended signal conductor, or one of a differential signal pair of signal conductors. The contacts designated G may be ground contacts, the terminal ends of which may be extended beyond the terminal ends of the other contacts. Thus, the ground contacts G may mate with complementary receptacle contacts before any of the signal contacts mates.

As shown, the IMLAs are arranged such that contact sets 206 form contact columns, though it should be understood that the IMLAs could be arranged such that the contact sets are contact rows. Also, though the header connector 200 is depicted with 150 contacts (i.e., 10 IMLAs with 15 contacts per IMLA), it should be understood that an IMLA may include any desired number of contacts and a connector may include any number of IMLAs. For example, IMLAs having 12 or 9 electrical contacts are also contemplated. A connector according to the invention, therefore, may include any number of contacts.

The header connector 200 includes an electrically insulating IMLA frame 208 through which the contacts extend. Preferably, each IMLA frame 208 is made of a dielectric material such as a plastic. According to an aspect of the invention, the IMLA frame 208 is constructed from as little material as possible. Otherwise, the connector is air-filled. That is, the contacts may be insulated from one another using air as a second dielectric. The use of air provides for a decrease in crosstalk and for a low-weight connector (as compared to a connector that uses a heavier dielectric material throughout).

The contacts 204 include terminal ends 210 for engagement with a circuit board. Preferably, the terminal ends are compliant terminal ends, though it should be understood that the terminals ends could be press-fit or any surface-mount or through-mount terminal ends. The contacts also include mating ends 212 for engagement with complementary receptacle contacts (described below in connection with FIGS. 4A and 4B).

As shown in FIG. 2A, a housing 214A is preferred. The housing 214A includes first and second walls 218A. FIG. 2B depicts a header connector with a housing 214B that includes a first pair of end walls 216B and a second pair of walls 218B.

The header connector may be devoid of any internal shielding. That is, the header connector may be devoid of any shield plates, for example, between adjacent contact sets. A connector according to the invention may be devoid of such internal shielding even for high-speed, high-frequency, fast rise-time signaling.

Though the header connector 200 depicted in FIGS. 2A and 2B is shown as a right-angle connector, it should be understood that a connector according to the invention may be any style connector, such as a mezzanine connector, for example. That is, an appropriate header connector may be designed according to the principles of the invention for any type connector.

Figure 4A:
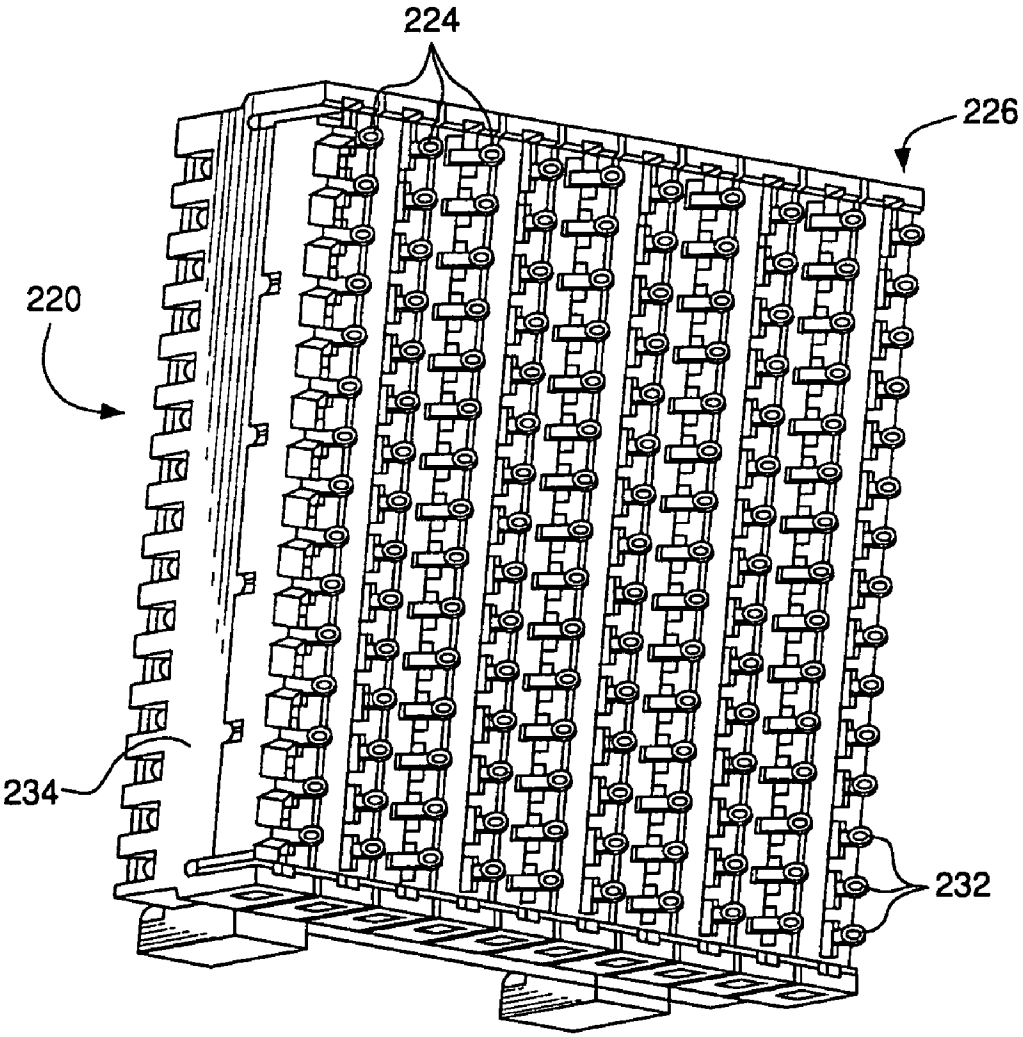
FIGS. 4A and 4B depict an example embodiment of a receptacle connector.
Figure 4B:
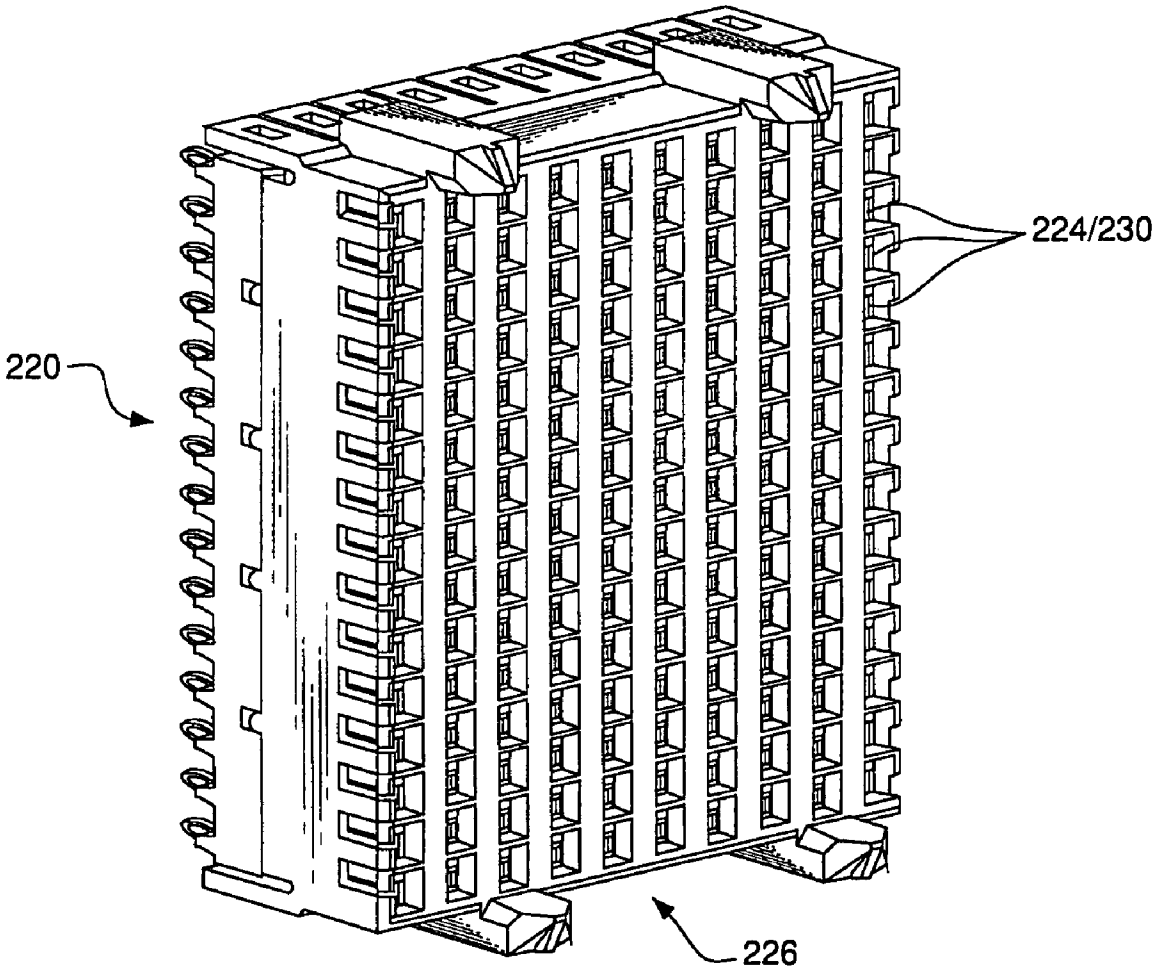

FIGS. 4A and 4B depict an example embodiment of a receptacle connector 220. The receptacle connector 220 includes a plurality of receptacle contacts 224, each of which is adapted to receive a respective mating end 212. Further, the receptacle contacts 224 are in an arrangement that is complementary to the arrangement of the mating ends 212. Thus, the mating ends 212 may be received by the receptacle contacts 224 upon mating of the assemblies. Preferably, to complement the arrangement of the mating ends 212, the receptacle contacts 224 are arranged to form contact sets 226. Again, though the receptacle connector 220 is depicted with 150 contacts (i.e., 15 contacts per column), it should be understood that a connector according to the invention may include any number of contacts.

Each receptacle contact 224 has a mating end 230, for receiving a mating end 212 of a complementary header contact 204, and a terminal end 232 for engagement with a circuit board. Preferably, the terminal ends 232 are compliant terminal ends, though it should be understood that the terminals ends could be press-fit, balls, or any surface-mount or through-mount terminal ends. A housing 234 is also preferably provided to position and retain the IMLAs relative to one another.

According to an aspect of the invention, the receptacle connector may also be devoid of any internal shielding. That is, the receptacle connector may be devoid of any shield plates, for example, between adjacent contact sets.

Figure 5B:
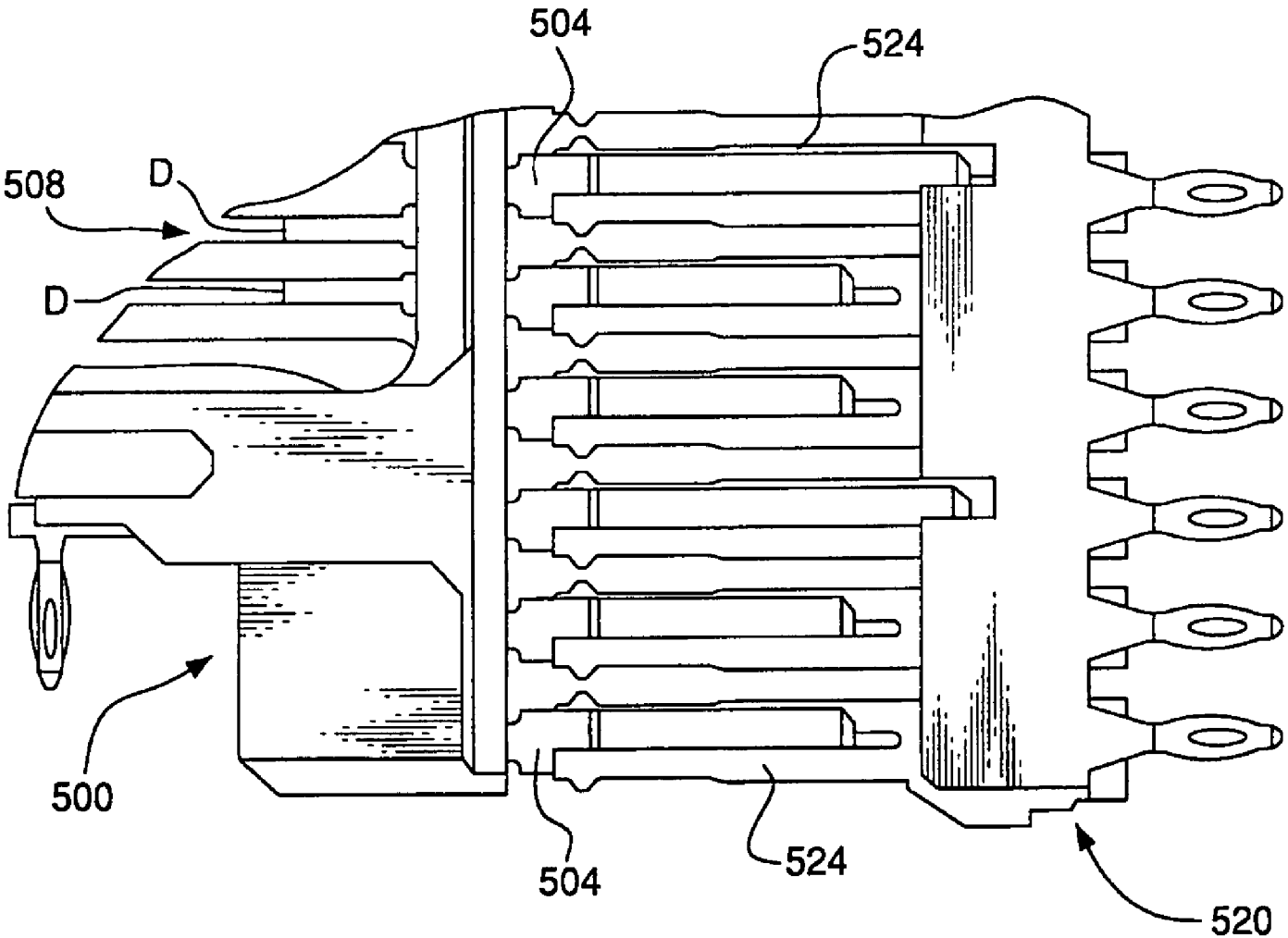

FIGS. 5A-D depict engaged blade and receptacle contacts in a connector system. FIG. 5A is a side view of a mated connector system including engaged blade contacts 504 and receptacle contacts 524. As shown in FIG. 5A, the connector system may include a header connector 500 that includes one or more blade contacts 504, and a receptacle connector 520 that includes one or more receptacle contacts 524.

FIG. 5B is a partial, detailed view of the connector system shown in FIG. 5A. Each of a plurality of blade contacts 504 may engage a respective one of a plurality of receptacle contacts 524. As shown, blade contacts 504 may be disposed along, and extend through, an IMLA in the header connector 500. Receptacle contacts 524 may be disposed along, and extend through, an IMLA in the receptacle connector 520. Contacts 504 may extend through respective air regions 508 and be separated from one another in the air region 508 by a distance D.

Figure 5D:
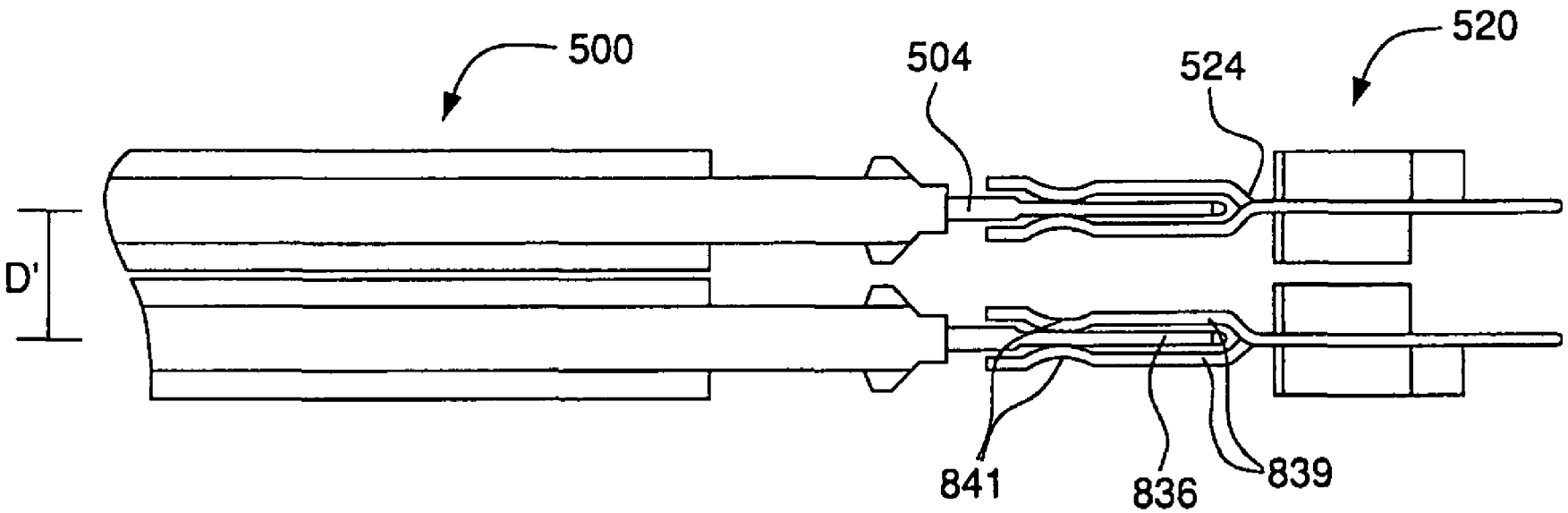

FIG. 5C is a partial top view of engaged blade and receptacle contacts in adjacent IMLAs. FIG. 5D is a partial detail view of the engaged blade and receptacle contacts shown in FIG. 5C. Either or both of the contacts may be signal contacts or ground contacts, and the pair of contacts may form a differential signal pair. Either or both of the contacts may be single-ended signal conductors.

Each blade contact 504 extends through a respective IMLA 506. Contacts 504 in adjacent IMLAs may be separated from one another by a distance D'. Blade contacts 504 may be received in respective receptacle contacts 524 to provide electrical connection between the blade contacts 504 and respective receptacle contacts 524. As shown, a terminal portion 836 of blade contact 504 may be received by a pair of beam portions 839 of a receptacle contact 524. Each beam portion 839 may include a contact interface portion 841 that makes electrical contact with the terminal portion 836 of the blade contact 504. Preferably, the beam portions 839 are sized and shaped to provide contact between the blades 836 and the contact interfaces 841 over a combined surface area that is sufficient to maintain the electrical characteristics of the connector during mating and unmating of the connector.

Figure 6:
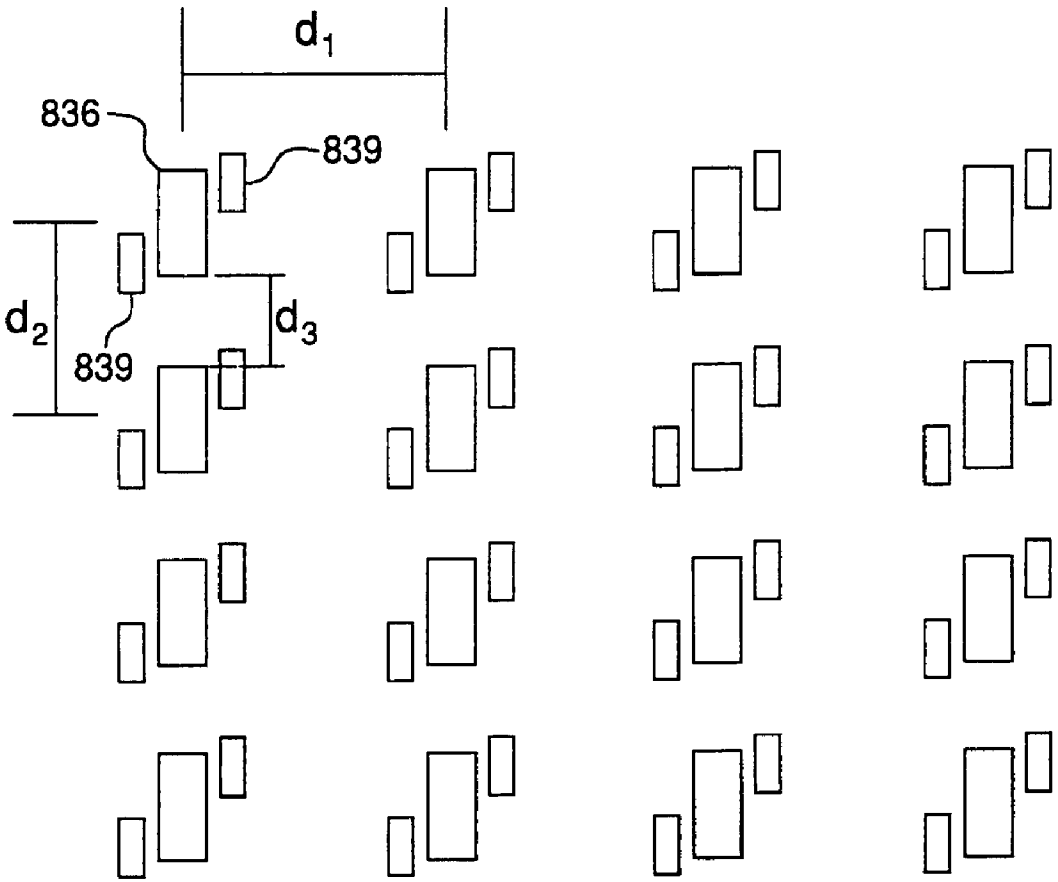
FIG. 6 (Prior Art)
FIG. 6 depicts a cross-sectional view of a contact configuration for known connectors, such as the connector shown in FIGS. 5A-5D.

FIG. 6 depicts a cross-sectional view of a contact configuration for known connectors, such as the connector shown in FIGS. 5A-5D. As shown, terminal blades 836 of the blade contacts are received into beam portions 839 of the receptacle contacts. The contact configuration shown in FIG. 6 allows the edge-coupled aspect ratio to be maintained in the mating region. That is, the aspect ratio of column pitch $d_1$ to gap width $d_3$ may be chosen to limit cross talk in the connector. Also, because the cross-section of the unmated blade contact is nearly the same as the combined cross-section of the mated contacts, the impedance profile can be maintained even if the connector is partially unmated. This occurs, at least in part, because the combined cross-section of the mated contacts includes no more than one or two thickness of metal (the thicknesses of the blade and the contact interface), rather than three thicknesses as would be typical in prior art connectors. In such prior art connectors, mating or unmating results in a significant change in cross-section, and therefore, a significant change in impedance (which may cause significant degradation of electrical performance if the connector is not properly and completely mated). Because the contact cross-section does not change dramatically as the connector is unmated, the connector can provide nearly the same electrical characteristics when partially unmated (e.g. unmated by about 1-2 mm) as it does when fully mated.

As shown in FIG. 6, the contacts are arranged in contact columns set a distance $d_1$ apart. Thus, the column pitch (i.e., distance between adjacent contact columns) is $d_1$. Similarly, the distance between the contact centers of adjacent contacts in a given row is also $d_1$. The row pitch (i.e., distance between adjacent contact rows) is $d_2$. Similarly, the distance between the contact centers of adjacent contacts in a given column is $d_2$. Note the edge-coupling of adjacent contacts along each contact column. As shown in FIG. 6, a ratio between $d_1$ and $d_2$ may be approximately 1.3 to 1.7 in air, though those skilled in the art of electrical connectors will understand that $d_1$ and $d_2$ ratio may increase or decrease depending on the type of insulator.

Figure 7:
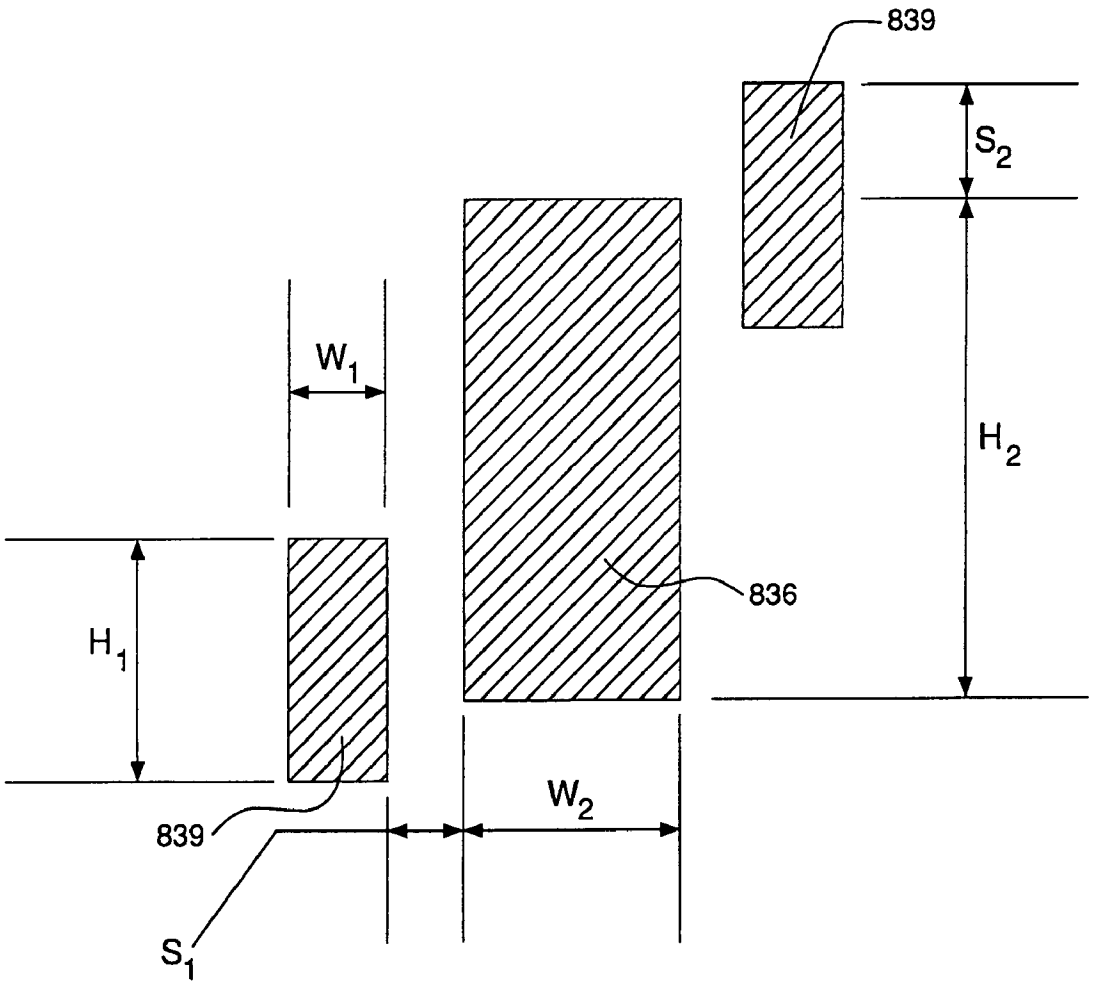
FIG. 7 (Prior Art)
FIG. 7 is a cross-sectional view of a blade contact engaged in a receptacle contact.

FIG. 7 is a detailed cross-sectional view of a blade contact 836 engaged in a receptacle contact 841 in a configuration as depicted in FIG. 6. Terminal blade 836 has a width $W_2$ and height $H_2$. Contact interfaces have a width $W_1$ and a height $H_1$. Contact interfaces 841 and terminal blade 836 may be spaced apart by a spacing $S_1$. Contact interfaces 841 are offset from terminal blade 836 by a distance $S_2$.

Figure 1A:
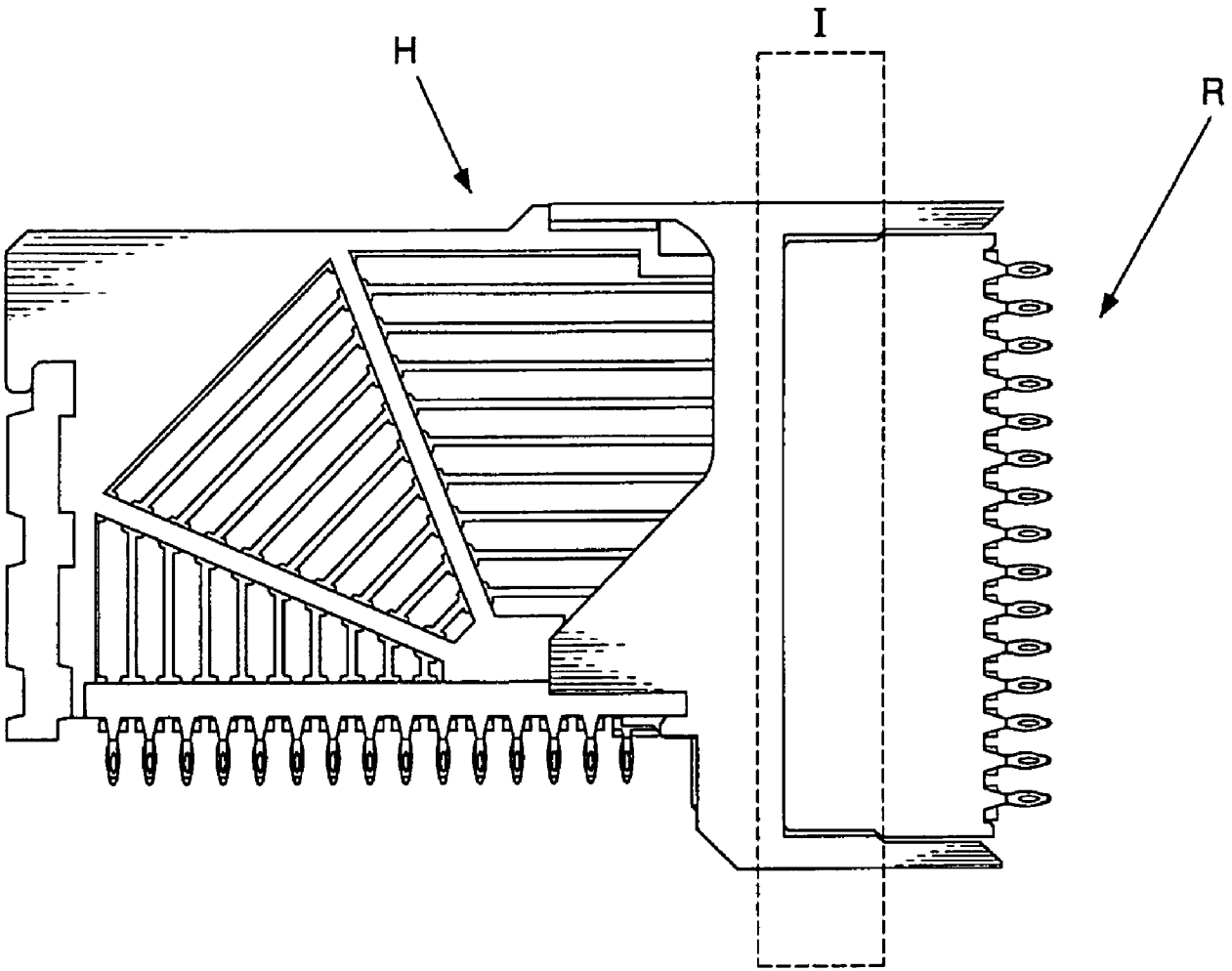
FIG. 1A is a side view of a typical electrical connector.
Figure 1B:
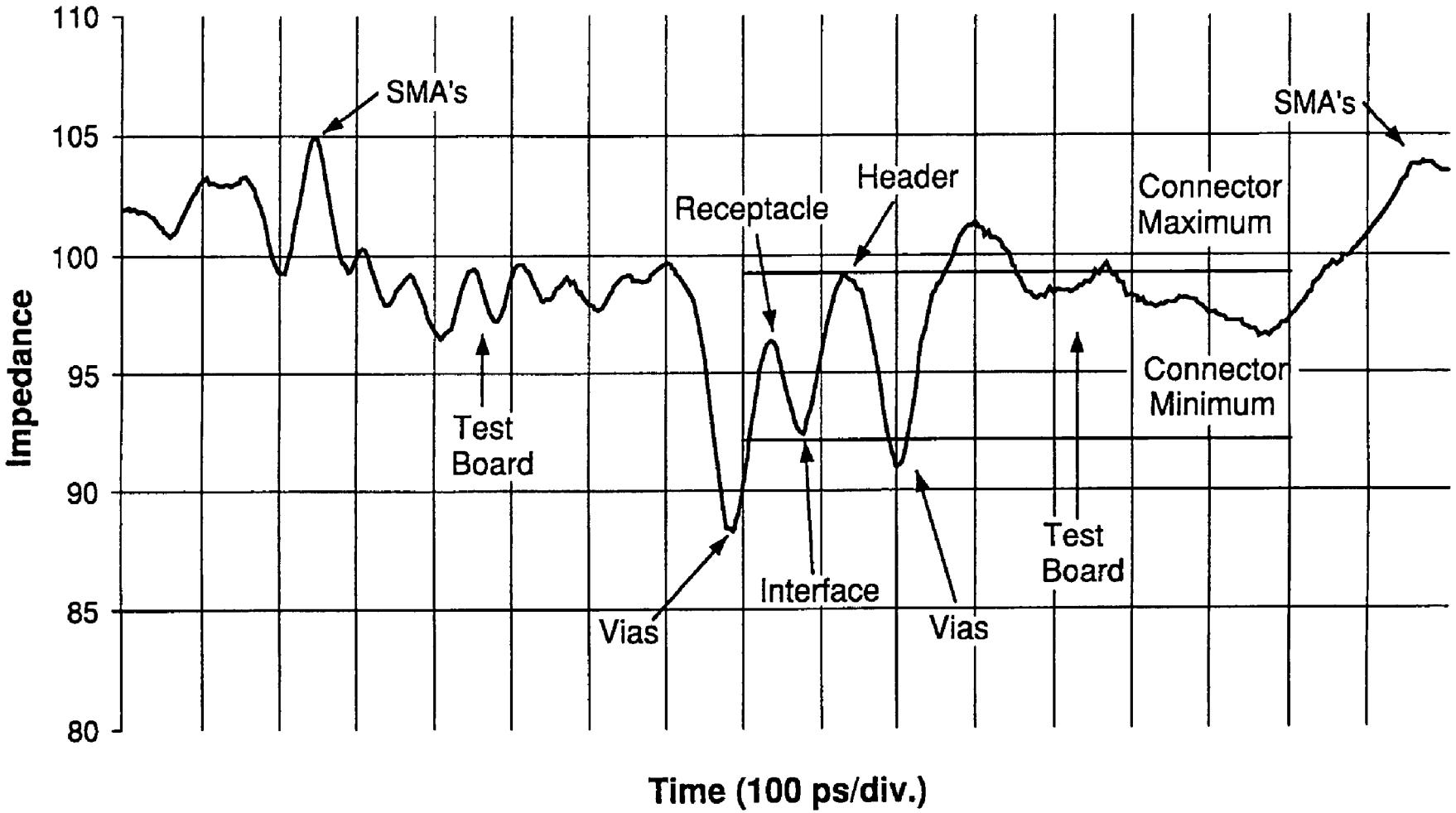
FIG. 1B is a reflection plot of differential impedance as a function of signal propagation time.
Figure 8A:
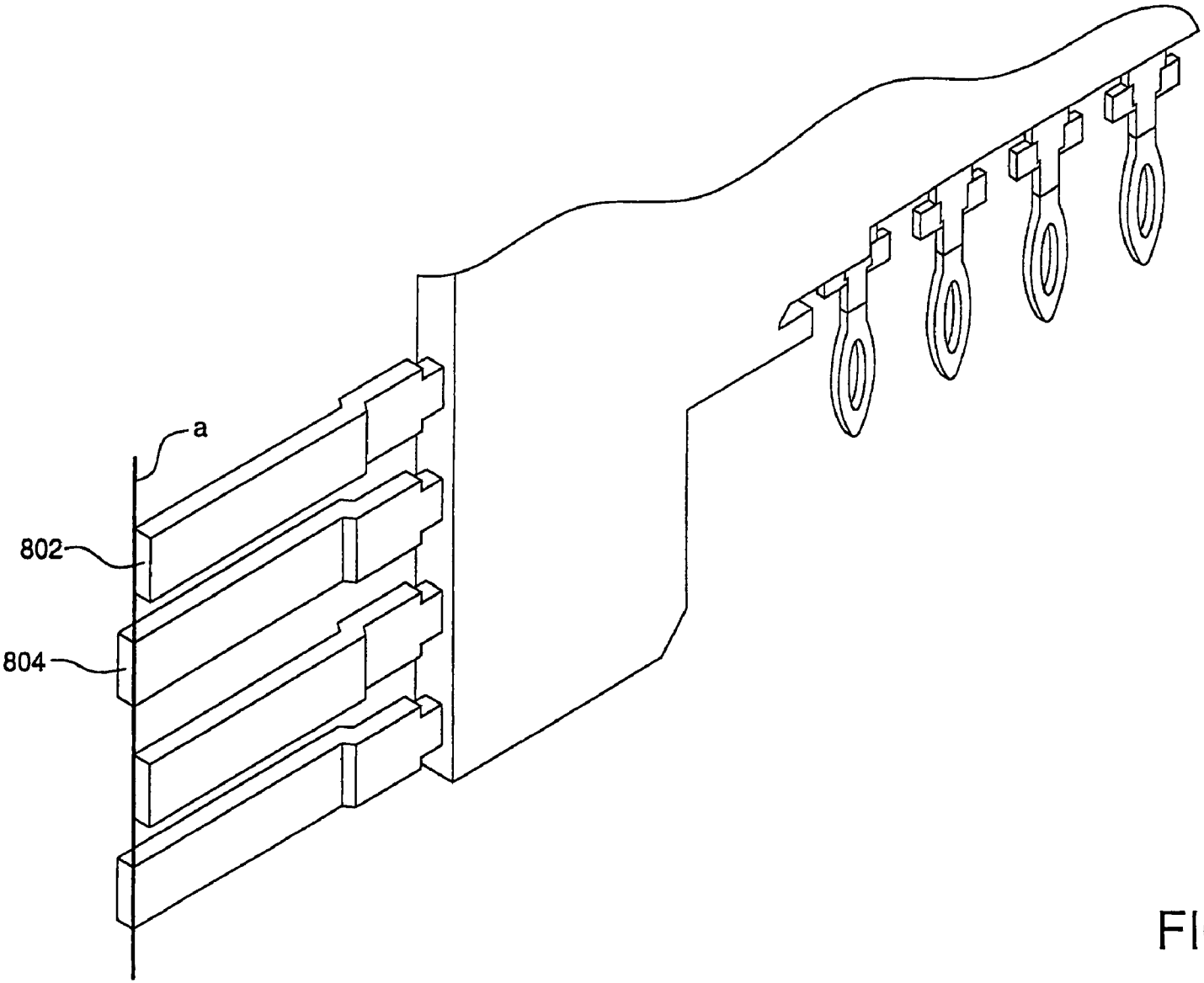
FIGS. 8A-15 depict example contact configurations according to the invention for adjusting impedance characteristics of an electrical connector.
Figure 8B:
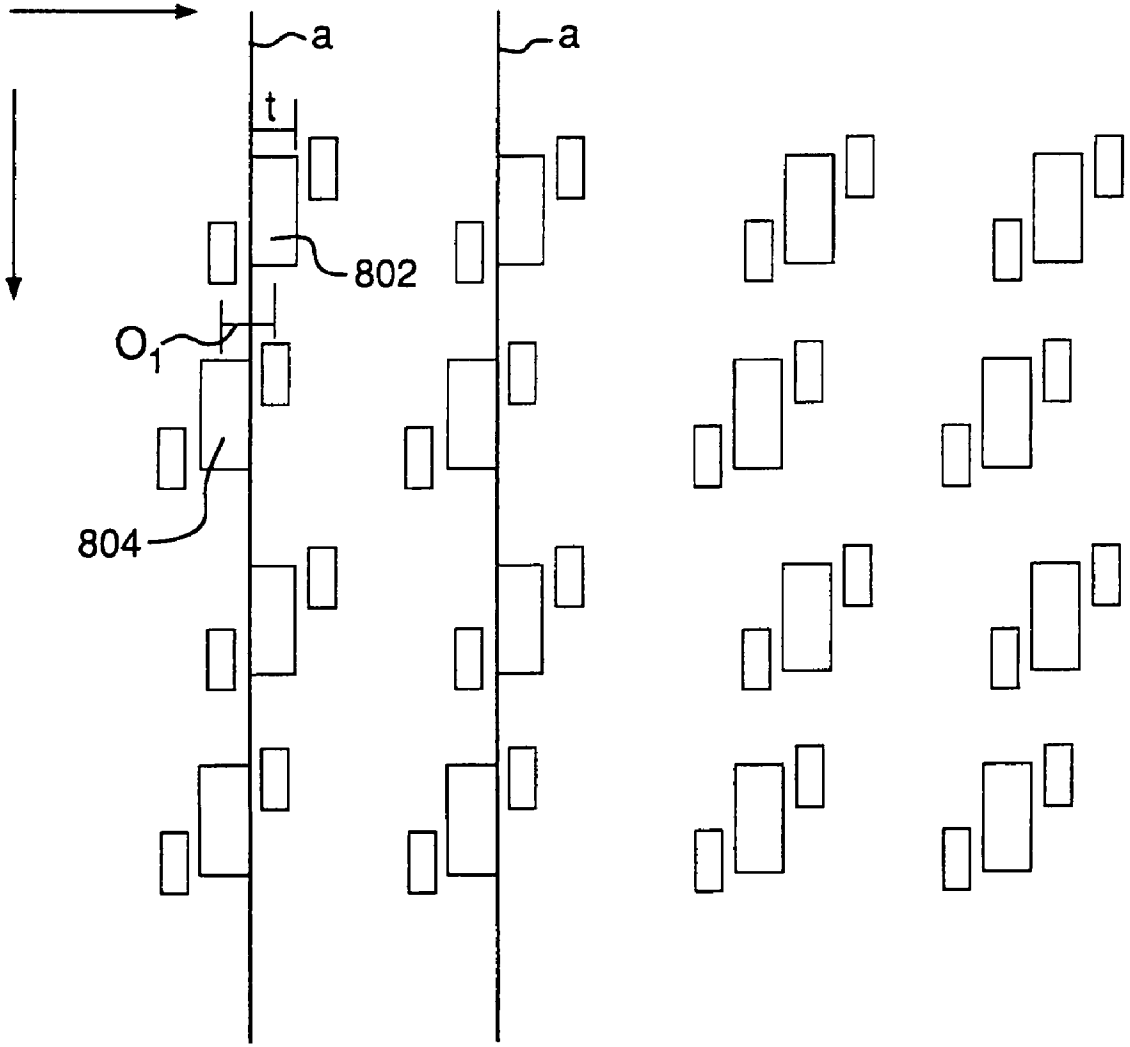

Though a connector having a contact arrangement such as shown in FIG. 6 is within acceptable standards (see FIG. 1B, for example), it has been discovered that a contact configuration such as that depicted in FIGS. 8A and 8B increases the impedance characteristics of such a connector by approximately 6.0Ω. That is, the differential impedance of a connector with a contact configuration as shown in FIGS. 8A and 8B (with contact dimensions that are approximately the same as those shown in FIG. 7) is approximately 115.0Ω. Such a contact configuration helps elevate the impedance in the header/receptacle interface area of the connector by interrupting the edge coupling between adjacent contacts.

FIGS. 8A and 8B depict a contact configuration wherein adjacent contacts 802 and 804 in a contact set are offset relative to one another. As shown, the contact set extends generally along a first direction (e.g., a contact column). Adjacent contacts 802 and 804 are offset relative to one another in a second direction relative to the centerline a of the contact set (i.e., in a direction perpendicular to the direction along which the contact set extends). Thus, as shown in FIGS. 8A and 8B, the contact rows may be offset relative to one another by an offset $o_1$, with each contact center being offset from the centerline a by about $o_1/2$.

Impedance drop may be minimized by moving edges of contacts out of alignment; that is, offsetting the contacts by an offset equal to the contact thickness t. In an example embodiment, t may be approximately 0.2-0.5 mm. Though the contacts depicted in FIGS. 8A and 8B are offset relative to one another by an offset equal to one contact thickness (i.e., by $o_1$=t), it should be understood that the offset may be chosen to achieve a desired impedance level. Further, though the offset depicted in FIGS. 8A and 8B is the same for all contacts, it should be understood that the offset could be chosen independently for any pair of adjacent contacts.

Preferably, the contacts are arranged such that each contact column is disposed in a respective IMLA. Accordingly, the contacts may be made to jog away from a contact column centerline a (which may or may not be collinear with the centerline of the IMLA). Preferably, the contacts are "misaligned," as shown in FIGS. 8A and 8B, only in the mating interface region. That is, the contacts preferably extend through the connector such that the terminal ends that mate with a board or another connector are not misaligned.

Figure 9:
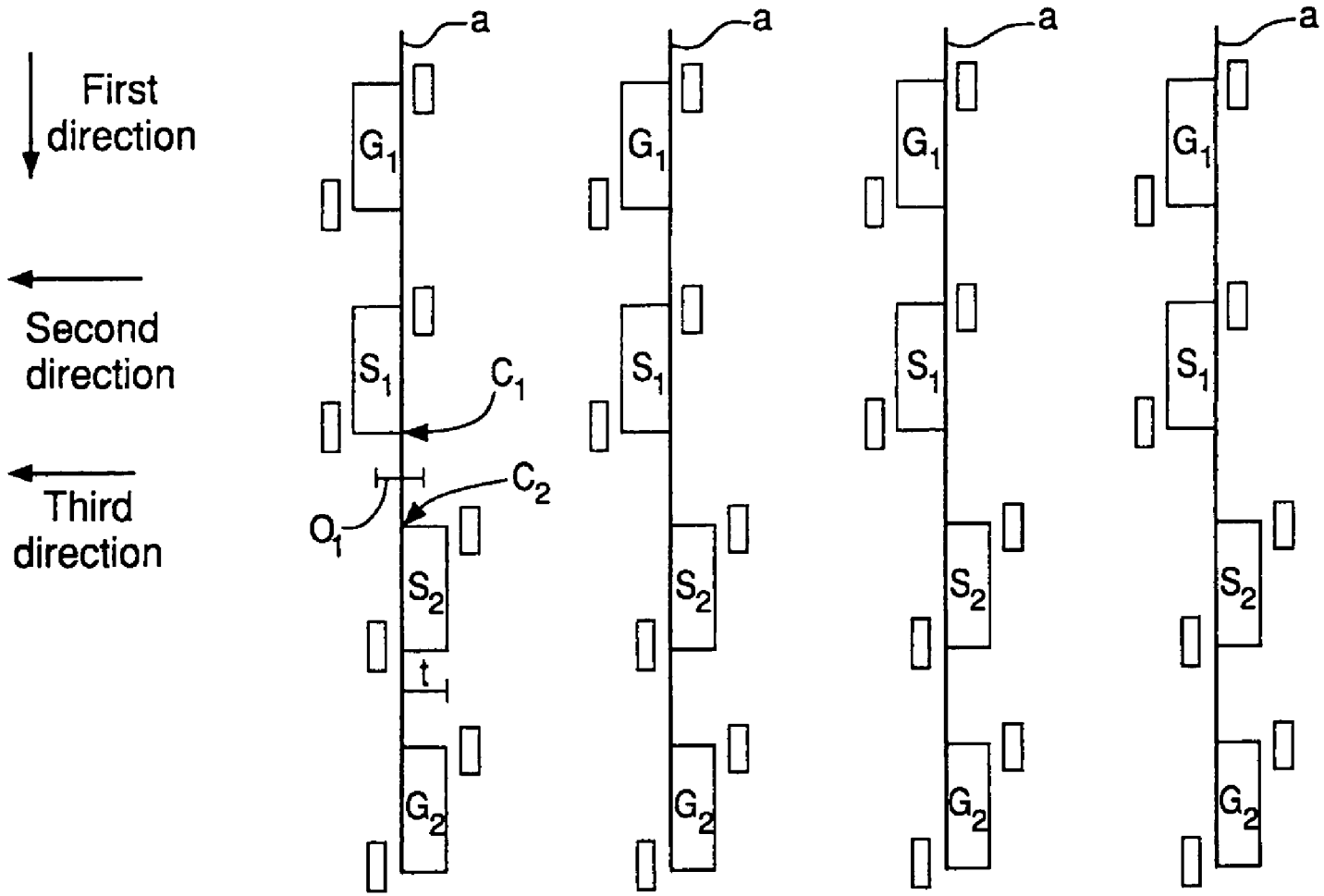

FIG. 9 depicts an alternative example of a contact arrangement for adjusting impedance by offsetting contacts of a contact set relative to one another. As shown, the contact set extends generally along a first direction (e.g., a contact column). Each contact column may be in an arrangement wherein two adjacent signal contacts $S_1$, $S_2$ are located in between two ground contacts $G_1$, $G_2$. Thus, the contact arrangement may be in a ground, signal, signal, ground configuration. The signal contacts $S_1$, $S_2$ may form a differential signal pair, though the contact arrangements herein described apply equally to single-ended transmission as well.

The ground contact $G_1$ may be aligned with the signal contact $S_1$ in the first direction. The ground contact $G_1$ and the signal contact $S_1$ may be offset in a second direction relative to a centerline a of the contact set. That is, the ground contact $G_1$ and the signal contact $S_1$ may be offset in a direction orthogonal to the first direction along which the contact set extends. Likewise, the ground contact $G_2$ and the signal contact $S_2$ may be aligned with each other and may be offset in a third direction relative to the centerline a of the contact set. The third direction may be orthogonal to the direction in which the contact column extends (i.e., the first direction) and opposite the second direction in which the ground contact $G_1$ and the signal contact $S_1$ may be offset relative to the centerline a. Thus as shown in FIG. 9 and irrespective of the location of the centerline a, the signal contact $S_1$ and the ground contact $G_1$ may be offset in a direction orthogonal to the direction in which the contact column extends relative to the signal contact $S_2$ and the ground contact $G_2$.

Impedance may be adjusted by offsetting contacts relative to each other such that, for example, a corner $C_1$ of the signal contact $S_1$ is aligned with a corner $C_2$ of the signal contact $S_2$. Thus the signal contact $S_1$ (and its adjacent ground contact $G_1$) is offset from the signal contact $S_2$ (and its adjacent ground contact $G_2$) in the second direction by the contact thickness t. In an example embodiment, t may be approximately 2.1 mm. Though the contacts in FIG. 9 are offset relative to one another by an offset equal to one contact thickness (i.e., by $O_1$=t), it should be understood that the offset may be chosen to achieve a desired impedance level. Thus, in alternative arrangements, the corners $C_1$, $C_2$ of respective signal contacts $S_1$, $S_2$ may be placed out of alignment. Further, though the offset depicted in FIG. 9 is the same for all contacts, it should be understood that the offset could be chosen independently for any pair of adjacent contacts.

The contacts may be arranged such that each contact column is disposed in a respective IMLA. Accordingly, the contacts may be made to jog away from a contact column centerline a (which may or may not be collinear with the centerline of the IMLA). The contacts offset in the mating interface region may extend through the connector such that the terminal ends that mate with a substrate, such as a PCB, or another connector are aligned, that is, not offset.

Figure 10:
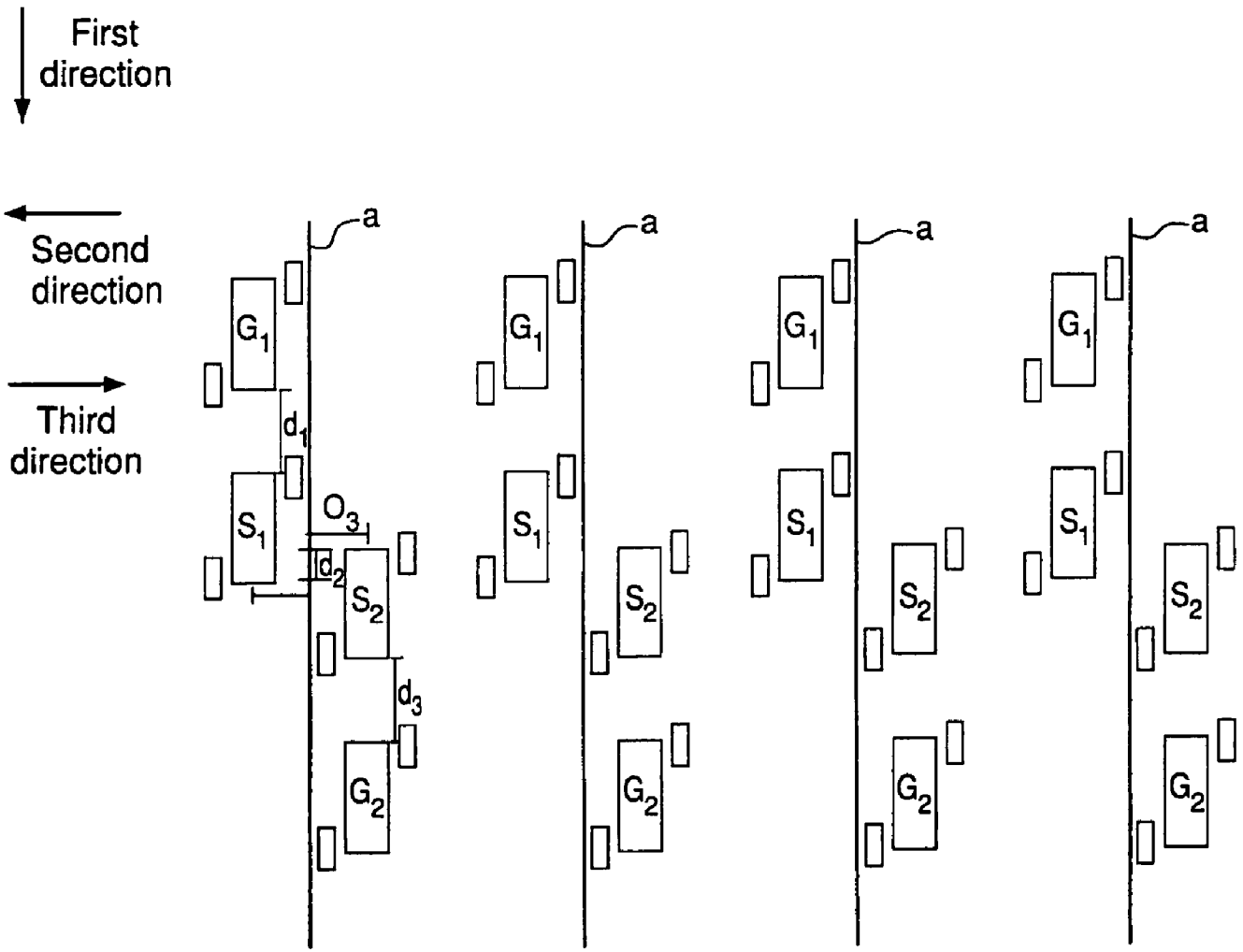

FIG. 10 depicts an alternative example of a contact arrangement for adjusting impedance by offsetting contacts of a contact set relative to one another. As shown, the contact set extends generally along a first direction (e.g., a contact column). Each contact column may be in an arrangement wherein two adjacent signal contacts $S_1$, $S_2$ are located in between two ground contacts $G_1$, $G_2$. Thus, the contact arrangement may be in a ground, signal, signal, ground configuration. The signal contacts $S_1$, $S_2$ may form a differential signal pair, though the contact arrangements herein described apply equally to single-ended transmission as well.

The ground contact $G_1$ and the signal contact $S_1$ may be aligned with each other and may be offset a distance $O_2$ in a second direction relative to a centerline a of the contact column. The second direction may be orthogonal to the first direction along which the contact column extends. The ground contact $G_2$ and the signal contact $S_2$ may be aligned with each other and may be offset a distance $O_3$ relative to the centerline a. The ground contact $G_2$ and the signal contact $S_2$ may be offset in a third direction that may be orthogonal to the first direction along which the contact column extends and may also be opposite the second direction. The distance $O_2$ may be less than, equal to, or greater than the distance $O_3$. Thus as shown in FIG. 10 and irrespective of the location of the centerline a, the signal contact $S_1$ and the ground contact $G_1$ may be offset in a direction orthogonal to the direction in which the contact column extends relative to the signal contact $S_2$ and the ground contact $G_2$.

The ground contact $G_1$ and the signal contact $S_1$ may be spaced apart in the first direction by a distance $d_1$. The ground contact $G_2$ and the signal contact $S_2$ may be spaced apart by a distance $d_3$ in the first direction. Portions of the signal contacts $S_1$, $S_2$ may "overlap" a distance $d_2$ in the first direction in which the contact column extends. That is, a portion having a length of $d_2$ of the signal contact $S_1$ may be adjacent, in the second direction (i.e., orthogonal to the first direction of the contact column), to a corresponding portion of the signal contact $S_2$. The distance $d_1$ may be less than, equal to, or greater than the distance $d_3$. The distance $d_2$ may be less than, equal to, or greater than the distance $d_1$ and the distance $d_3$. All distances $d_1$, $d_2$, $d_3$ may be chosen to achieve a desired impedance. Additionally, impedance may be adjusted by altering the offset distances $O_2$, $O_3$ that the contacts are offset relative to each other in a direction orthogonal to the direction in which the contact column extends (i.e., the first direction).

The contacts of FIG. 10 may be arranged such that each contact column is disposed in a respective IMLA. Accordingly, the contacts may be made to jog away from the contact column centerline a (which may or may not be collinear with the centerline of the IMLA). The contacts offset in the mating interface region may extend through the connector such that the terminal ends that mate with a substrate, such as a PCB, or another connector are aligned, that is, not offset.

Figure 11:
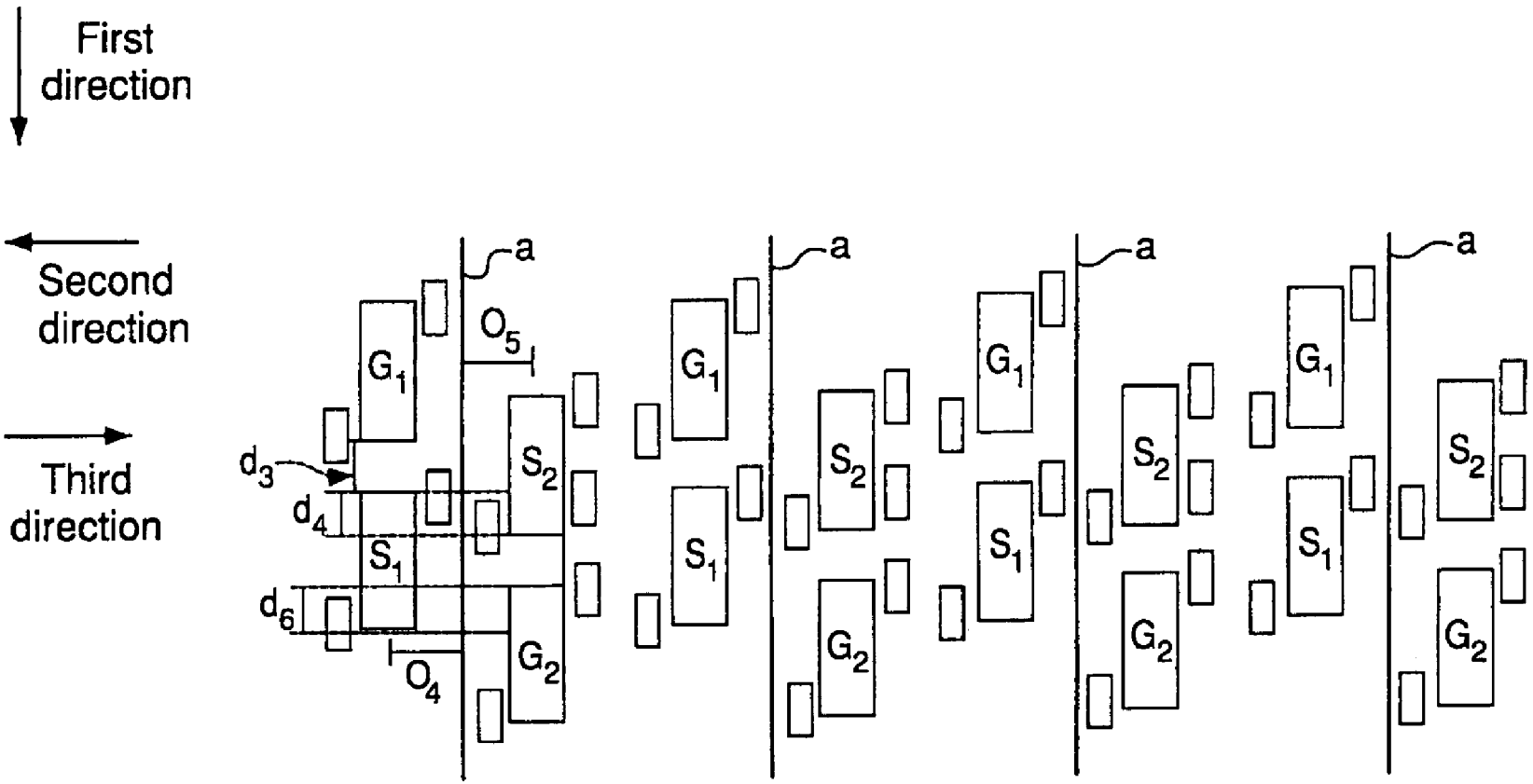

FIG. 11 depicts an alternative example of a contact arrangement for adjusting impedance by offsetting contacts of a contact set relative to one another. As shown, the contact set extends generally along a first direction (e.g., a contact column). Each contact column may be in an arrangement wherein two adjacent signal contacts $S_1$, $S_2$ are located in between two ground contacts $G_1$, $G_2$. Thus, the contact arrangement may be in a ground, signal, signal, ground configuration. The signal contacts $S_1$, $S_2$ may form a differential signal pair, though the contact arrangements herein described apply equally to single-ended transmission as well.

The ground contact $G_1$ and the signal contact $S_1$ may be offset a distance $O_4$ in a second direction relative to a centerline a of the contact (e.g., in a direction perpendicular to the direction along which the contact set extends). The ground contact $G_2$ and the signal contact $S_2$ may be offset the distance $O_5$ in a third direction relative to the centerline a of the contact set (e.g., in a direction opposite the second direction). Thus, for example, the ground contact $G_1$ and the signal contact $S_1$ may be offset the distance $O_4$ to the right of the centerline a, and the ground contact $G_2$ and the signal contact $S_2$ may be offset the distance $O_5$ to the left of the centerline a. The distance $O_4$ may be less than, equal to, or greater than the distance $O_5$. Thus as shown in FIG. 10 and irrespective of the location of the centerline a, the signal contact $S_1$ and the ground contact $G_1$ may be offset in a direction orthogonal to the direction in which the contact column extends relative to the signal contact $S_2$ and the ground contact $G_2$.

The ground contact $G_1$ and the signal contact $S_1$ may be spaced apart in the first direction (i.e., in the direction in which the contact column extends) by a distance $d_3$. The ground contact $G_2$ and the signal contact $S_2$ may be spaced apart by the distance $d_5$ in the first direction. The distance $d_3$ may be less than, equal to, or greater than the distance $d_5$. Portions of the signal contacts $S_1$, $S_2$ may "overlap" a distance $d_4$ in the first direction. That is, a portion of the signal contact $S_1$ may be adjacent to a portion of the signal contact $S_2$ in the second direction (i.e., in a direction orthogonal to the first direction). Likewise, a portion of the signal contact $S_1$ may be adjacent to a portion of the ground contact $G_2$ in the second direction. The signal contact $S_1$ may "overlap" the ground contact $G_2$ a distance $d_6$ or any other distance. That is, a portion of the signal contact $S_1$ having a length of $d_6$ may be adjacent to a corresponding portion of the ground contact $G_2$. The distance $d_6$ may be less than, equal to, or greater than the distance $d_4$, and distances $d_3$, $d_4$, $d_5$, $d_6$ may be chosen to achieve a desired impedance. Impedance also may be adjusted by altering the offset distances $O_4$, $O_5$ that contacts are offset relative to each other in a direction orthogonal to the direction in which the contact column extends.

The contacts of FIG. 11 may be arranged such that each contact column is disposed in a respective IMLA. Accordingly, the contacts may be made to jog away from the contact column centerline a (which may or may not be collinear with the centerline of the IMLA). The contacts offset in the mating interface region may extend through the connector such that the terminal ends that mate with a substrate, such as a PCB, or another connector are aligned, that is, not offset.

Figure 12:
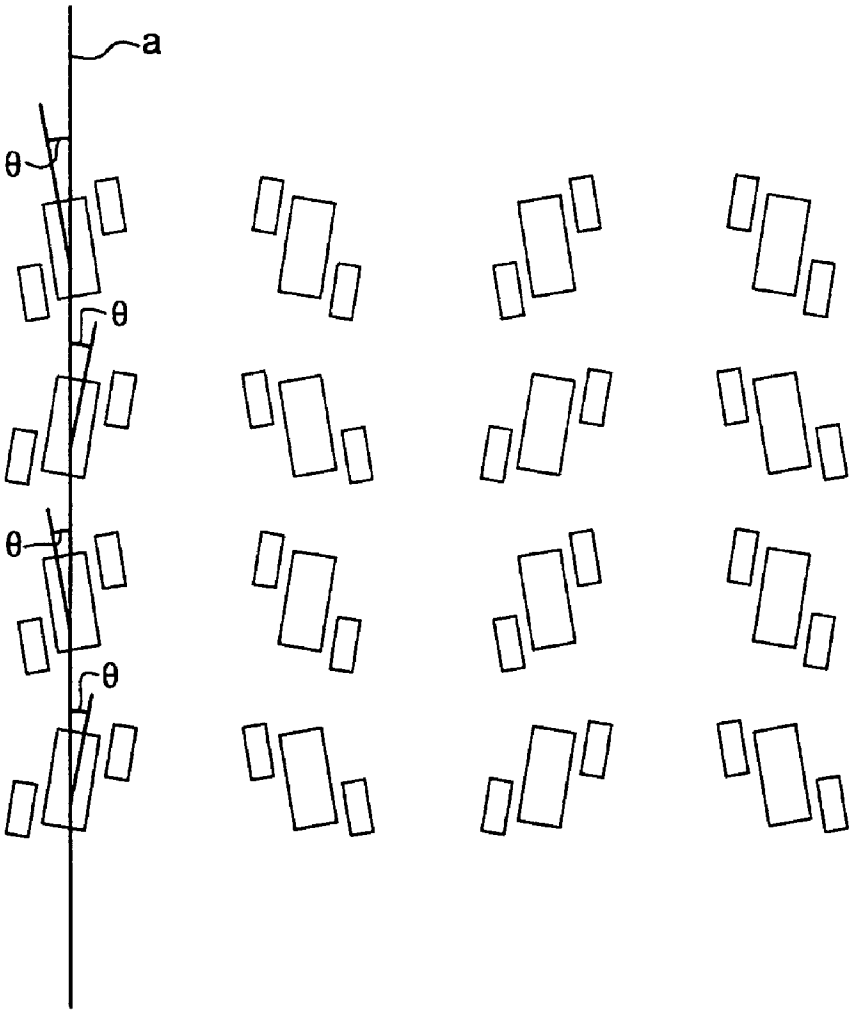

FIG. 12 depicts a contact configuration wherein adjacent contacts in a contact set are twisted or rotated in the mating interface region. Twisting or rotating the contact in the mating interface region may reduce differential impedance of a connector. Such reduction may be desirable when matching impedance of a device to a connector to prevent signal reflection, a problem that may be magnified at higher data rates. As shown, the contact set extends generally along a first direction (e.g. along centerline a, as shown), thus forming a contact column, for example, as shown, or a contact row. Each contact may be rotated or twisted relative to the centerline a of the contact set such that, in the mating interface region, it forms a respective angle $\theta$ with the contact column centerline a. In an example embodiment of a contact configuration as shown in FIG. 12, the angle $\theta$ may be approximately 10°. Impedance may be reduced by rotating each contact, as shown, such that adjacent contacts are rotated in opposing directions and all contacts form the same (absolute) angle with the centerline. The differential impedance in a connector with such a configuration may be approximately 108.7Ω, or 0.3Ω less than a connector in which the contacts are not rotated, such as shown in FIG. 6. It should be understood, however, that the angle to which the contacts are rotated may be chosen to achieve a desired impedance level. Further, though the angles depicted in FIG. 12 are the same for all contacts, it should be understood that the angles could be chosen independently for each contact.

Preferably, the contacts are arranged such that each contact column is disposed in a respective IMLA. Preferably, the contacts are rotated or twisted only in the mating interface region. That is, the contacts preferably extend through the connector such that the terminal ends that mate with a board or another connector are not rotated.

Figure 13:
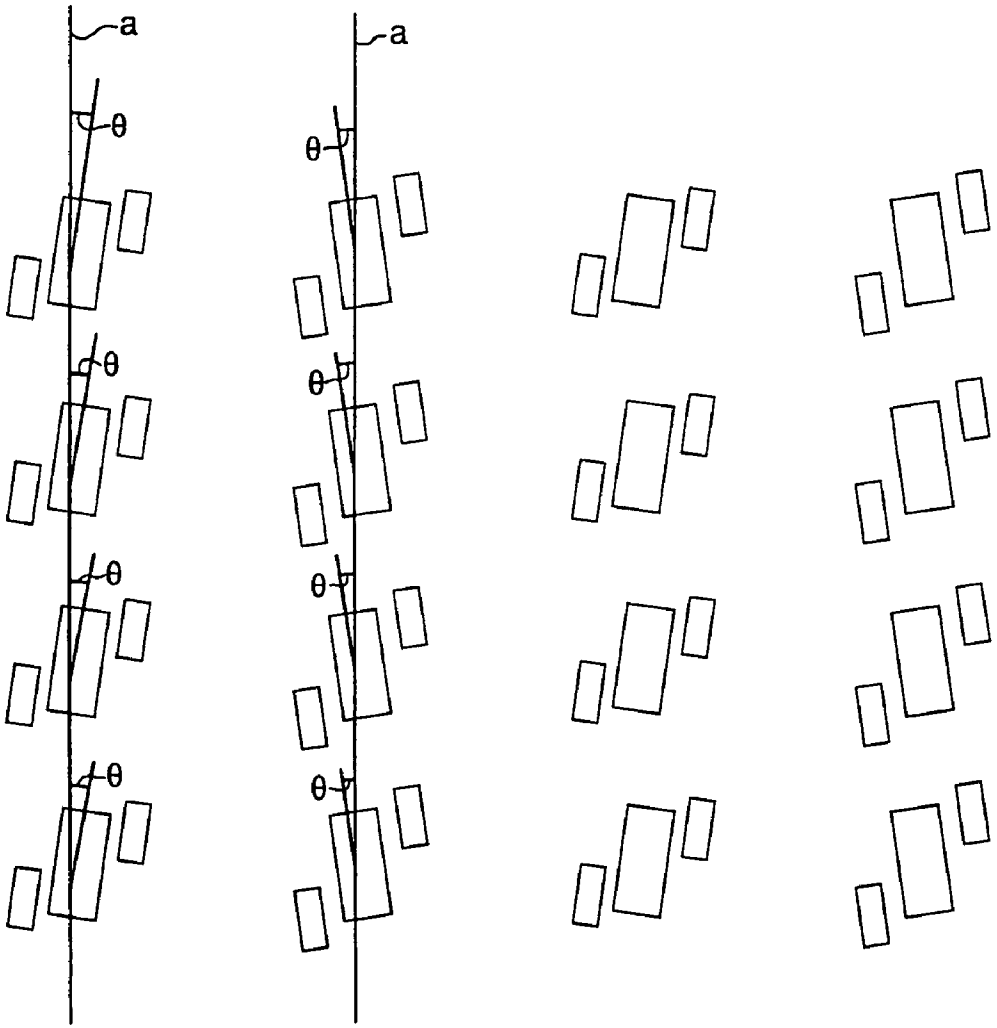

FIG. 13 depicts a contact configuration wherein adjacent contacts in a contact set are twisted or rotated in the mating interface region. By contrast with FIG. 12, however, each set of contacts depicted in FIG. 13 is shown twisted or rotated in the same direction relative to the centerline a of the contact set. Such a configuration may lower impedance more than the configuration of FIG. 12, offering an alternative way that connector impedance may be fine-tuned to match an impedance of a device.

As shown, each contact set extends generally along a first direction (e.g., along centerline a, as shown), thus forming a contact column, for example, as shown, or a contact row. Each contact may be rotated or twisted such that it forms a respective angle θ with the contact column centerline a in the mating interface region. In an example embodiment, the angle θ may be approximately 10°. The differential impedance in a connector with such a configuration may be approximately 104.2Ω, or 4.8Ω less than in a connector in which the contacts are not rotated, as shown in FIG. 6, and approximately 4.5Ω less than a connector in which adjacent contacts are rotated in opposing directions, as shown in FIG. 12.

It should be understood that the angle to which the contacts are rotated may be chosen to achieve a desired impedance level. Further, though the angles depicted in FIG. 13 are the same for all contacts, it should be understood that the angles could be chosen independently for each contact. Also, though the contacts in adjacent contact columns are depicted as being rotated in opposite directions relative to their respective centerlines, it should be understood that adjacent contact sets may be rotated in the same or different directions relative to their respective centerlines a.

Figure 14:
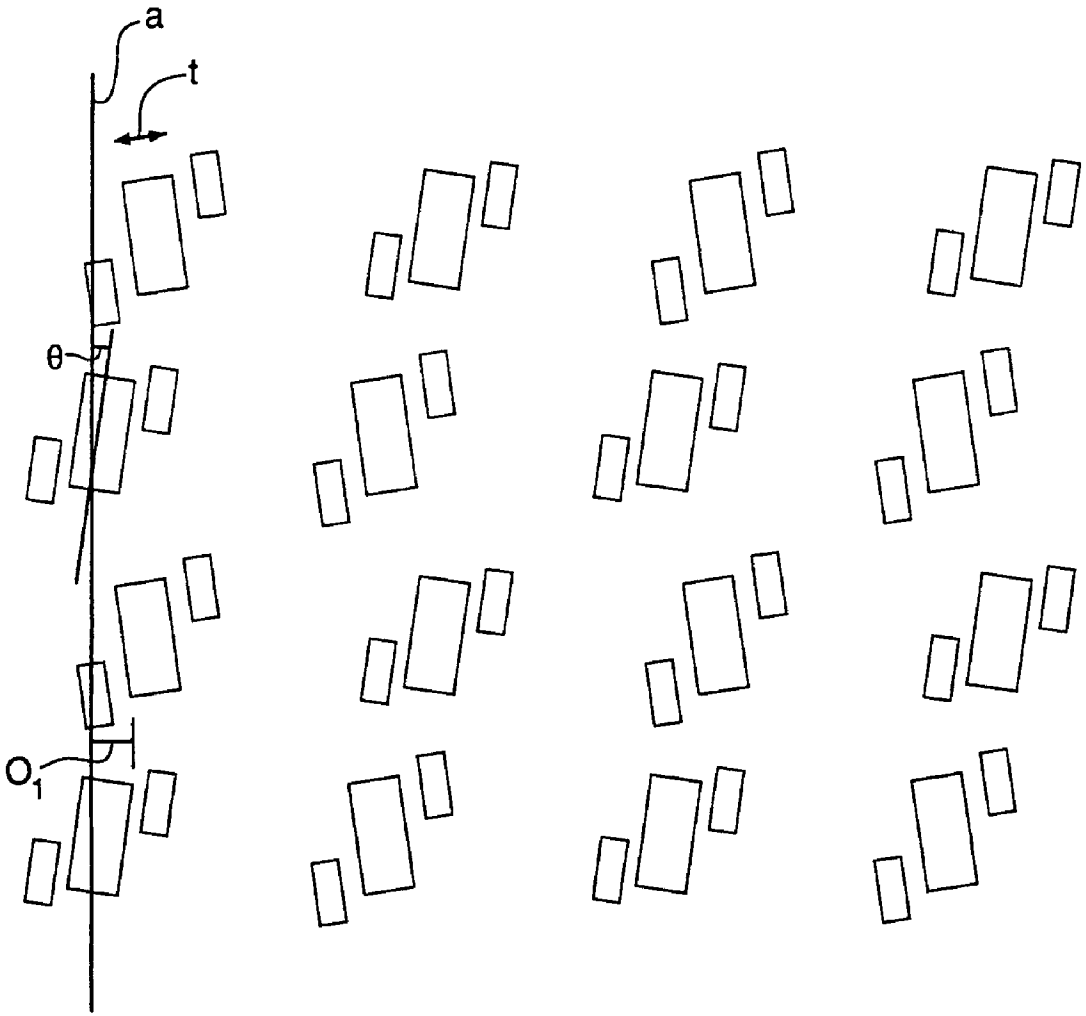

FIG. 14 depicts a contact configuration wherein adjacent contacts within a set are rotated in opposite directions and are offset relative to one another. Each contact set may extend generally along a first direction (e.g. along centerline a, as shown), thus forming a contact column, for example, as shown, or a contact row. Within each column, adjacent contacts may be offset relative to one another in a second direction (e.g., in the direction perpendicular to the direction along which the contact set extends). As shown in FIG. 14, adjacent contacts may be offset relative to one another by an offset $o_1$. Thus, it may be said that adjacent contact rows are offset relative to one another by an offset $o_1$. In an example embodiment, the offset $o_1$ may be equal to the contact thickness t, which may be approximately 2.1 mm, for example.

Additionally, each contact may be rotated or twisted in the mating interface region such that it forms a respective angle θ with the contact column centerline. Adjacent contacts may be rotated in opposing directions, and all contacts form the same (absolute) angle with the centerline, which may be 10°, for example. The differential impedance in a connector with such a configuration may be approximately 114.8Ω.

Figure 15:
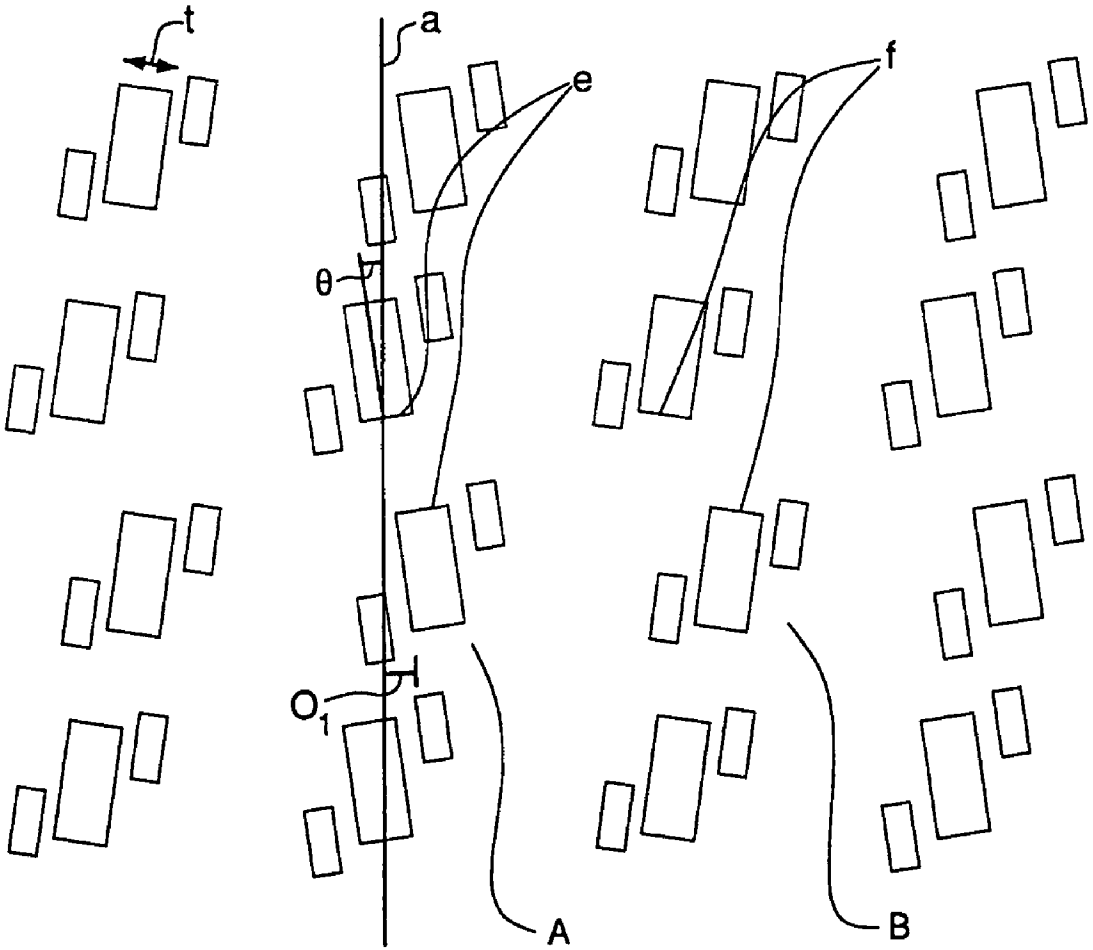

FIG. 15 depicts a contact configuration in which the contacts have been both rotated and offset relative to one another. Each contact set may extend generally along a first direction (e.g., along centerline a, as shown), thus forming a contact column, for example, as shown, or a contact row. Adjacent contacts within a column may be rotated in the same direction relative to the centerline a of their respective columns. Also, adjacent contacts may be offset relative to one another in a second direction (e.g., in the direction perpendicular to the direction along which the contact set extends). Thus, contact rows may be offset relative to one another by an offset $o_1$, which may be, for example, equal to the contact thickness t. In an example embodiment, contact thickness t may be approximately 2.1 mm. Each contact may also be rotated or twisted such that it forms a respective angle with the contact column centerline in the mating interface region. In an example embodiment, the angle of rotation θ may be approximately 10°.

In the embodiment shown in FIG. 15, the differential impedance in the connector may vary between contact pairs. For example, contact pair A may have a differential impedance of 110.8Ω, whereas contact pair B may have a differential impedance of 118.3Ω. The varying impedance between contact pairs may be attributable to the orientation of the contacts in the contact pairs. In contact pair A, the twisting of the contacts may reduce the effects of the offset because the contacts largely remain edge-coupled. That is, edges e of the contacts in contact pair A remain facing each other. In contrast, edges f of the contacts of contact pair B may be such that edge coupling is limited. For contact pair B, the twisting of the contacts in addition to the offset may reduce the edge coupling more than would be the case if offsetting the contacts without twisting.

Also, it is known that decreasing impedance (by rotating contacts as shown in FIGS. 12 & 13, for example) increases capacitance. Similarly, decreasing capacitance (by moving the contacts out of alignment as shown in FIG. 8, for example) increases impedance. Thus, the invention provides an approach for adjusting impedance and capacitance, in a controlled manner, to a target level.

It should be understood that even though numerous characteristics and advantages of the present invention have been set forth in the foregoing description, the disclosure is illustrative only and changes may be made in detail within the principles of the invention to the full extent indicated by the broad general meaning of the terms in which appended claims are expressed. For example, the dimensions of the contacts and contact configurations in FIGS. 6-15 are provided for example purposes, and other dimensions and configurations may be used to achieve a desired impedance or capacitance. Additionally, the invention may be used in other connectors besides those depicted in the detailed description.

What is claimed:

1. An electrical connector, comprising:

a first electrically conductive contact disposed on a common centerline, the first contact defining a first mating end;

a second electrically conductive contact disposed on the common centerline and adjacent the first contact, the second contact defining a second mating end;

a third electrically conductive contact disposed on the common centerline and adjacent the second contact, the third contact defining a third mating end; and a fourth electrically conductive contact disposed on the common centerline and adjacent the third contact, the fourth contact defining a fourth mating end, wherein (i) the first and second mating ends are each offset from the common centerline in a first direction that is substantially perpendicular to the common centerline, (ii) the third and fourth mating ends are each offset from the common centerline in a second direction that is substantially perpendicular to the common centerline, (iii) the first direction is substantially opposite the second direction, (iv) the second mating end and the third mating end overlap a first distance that extends along the common centerline, and (v) the second and third electrically conductive contacts define a differential signal pair.

2. The electrical connector of claim 1, wherein the second mating end is adjacent the first mating end along a third direction that is parallel to the common centerline, and the fourth mating end is adjacent the third mating end along the third direction.

3. The electrical connector of claim 1, wherein the first and second mating ends are each offset from the common centerline by a second distance, the third and fourth mating ends are each offset from the common centerline by a third distance, and the second distance is equal to the third distance.

4. The electrical connector of claim 1, wherein the first and fourth contacts are ground contacts and the second and third contacts are signal contacts.

5. The electrical connector of claim 1, wherein the contacts are disposed in an insert molded lead frame assembly.

6. The electrical connector of claim 1, wherein the first and second contacts have terminal ends, and wherein the terminal end of the second contact is not offset relative to the terminal end of the third contact.

7. The electrical connector of claim 1, wherein the first mating end and the third mating end overlap a second distance that extends along the common centerline.

8. The electrical connector of claim 7, wherein the second mating end and the fourth mating end overlap a third distance that extends along the common centerline.

9. The electrical connector of claim 8, wherein the first distance, the second distance and the third distance are substantially equal.

10. The electrical connector of claim 1, wherein the second contact is disposed adjacent the first contact along a third direction that extends parallel to the common centerline, the third contact is disposed adjacent the second contact along the third direction, and the fourth contact is disposed adjacent the third contact along the third direction.

11. An electrical connector, comprising:

a column of electrically-conductive contacts arranged coincident with a common centerline that extends in a first direction, wherein each contact of the column of contacts defines a mating end, wherein (i) a first contact of the column of contacts has a mating end that is offset from the common centerline in a second direction that is substantially perpendicular to the first direction, (ii) a second contact of the column of contacts has a mating end that is offset from the common centerline in a third direction that is substantially perpendicular to the first direction, (iii) the second direction is substantially opposite to the third direction, (iv) the mating end of the first contact and the mating end of the second contact overlap a first distance that extends along the first direction, and (v) the first and second contacts define a differential signal pair.

12. The electrical connector of claim 11, wherein the first and second contacts are signal contacts.

13. The electrical connector of claim 12, further comprising a first ground contact of the column of contacts that has a mating end that is offset from the common centerline in the second direction and a second ground contact of the column of contacts that has a mating end that is offset from the common centerline in the third direction.

14. The electrical connector of claim 13 wherein the mating end of the first ground contact and the mating end of the second signal contact overlap a second distance that extends along the first direction.

15. The electrical connector of claim 14, wherein the mating end of the second ground contact and the mating end of the first signal contact overlap a third distance that extends along the first direction.

16. The electrical connector of claim 11, wherein the contacts are disposed in an insert molded lead frame assembly.

17. An electrical connector, comprising:

a column of electrically-conductive contacts, the column extending along a first direction such that the contacts are aligned along the first direction, the column of contacts comprising a first set of two adjacent contacts having mating ends that are aligned with each other in the first direction and a second set of two adjacent contacts having mating ends that are aligned with each other in the first direction, wherein a mating end of at least one contact of the second set overlaps with a mating end of at least one contact of the first set by a first distance that extends along the first direction, the mating ends of the contacts of the second set are offset relative to the mating ends of the contacts of the first set in a second direction that is substantially perpendicular to the first direction, and the contact of the first set and the contact of the second set whose mating ends overlap define a differential signal pair.

18. The electrical connector of claim 17, wherein the column of electrically-conductive contacts is disposed in a lead frame housing.

19. The electrical connector of claim 17, wherein the first set comprises a first ground contact adjacent to a first signal contact, and the second set comprises a second ground contact adjacent to a second signal contact.

20. The electrical connector of claim 17, wherein the mating end of the at least one contact of the second set overlaps with a mating end of the other contact of the first set by a second distance that extends along the first direction.

* * * * *